US009476618B2

(12) United States Patent
Takenaka et al.

(10) Patent No.: US 9,476,618 B2
(45) Date of Patent: Oct. 25, 2016

(54) AIR CONDITIONING APPARATUS

(75) Inventors: Naofumi Takenaka, Chiyoda-ku (JP); Shinichi Wakamoto, Chiyoda-ku (JP); Koji Yamashita, Chiyoda-ku (JP); Hiroyuki Morimoto, Chiyoda-ku (JP); Yusuke Shimazu, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 851 days.

(21) Appl. No.: 13/503,572

(22) PCT Filed: Oct. 23, 2009

(86) PCT No.: PCT/JP2009/068256

§ 371 (c)(1),
(2), (4) Date: Apr. 23, 2012

(87) PCT Pub. No.: WO2011/048695

PCT Pub. Date: Apr. 28, 2011

(65) Prior Publication Data

US 2012/0204588 A1 Aug. 16, 2012

(51) Int. Cl.

| | |
|---|---|
| ***F24D 17/02*** | (2006.01) |
| ***F24D 3/08*** | (2006.01) |
| ***F25B 29/00*** | (2006.01) |
| *F25B 9/00* | (2006.01) |
| *F25B 13/00* | (2006.01) |

(52) U.S. Cl.

CPC ..... *F25B 29/003* (2013.01); *F25B 9/008* (2013.01); *F25B 13/00* (2013.01); *F25B 2309/061* (2013.01); *F25B 2313/0231* (2013.01); *F25B 2339/047* (2013.01)

(58) Field of Classification Search

CPC .. F25B 9/008; F25B 13/00; F25B 2339/047; F25B 2309/061; F25B 2313/0231; F25B 29/003

USPC ..... 62/238.7

See application file for complete search history.

(56) References Cited

U.S. PATENT DOCUMENTS

| | | | | |
|---|---|---|---|---|
| 5,272,885 | A | 12/1993 | Watanabe | |
| 7,254,955 | B2 * | 8/2007 | Otake et al. | 62/238.7 |
| 2002/0002834 | A1 * | 1/2002 | Kuroki | F24D 19/1054 62/238.6 |

(Continued)

FOREIGN PATENT DOCUMENTS

| | | |
|---|---|---|
| JP | 58 92737 | 6/1983 |
| JP | 60 16275 A | 1/1985 |

(Continued)

OTHER PUBLICATIONS

Japanese Office Action issued May 7, 2013 in Patent Application No. 2011-537073 with English Translation.

(Continued)

*Primary Examiner* — Frantz Jules
*Assistant Examiner* — Martha Tadesse
(74) *Attorney, Agent, or Firm* — Oblon, McClelland, Maier & Neustadt, L.L.P.

(57) ABSTRACT

An air-conditioning apparatus in which a heat source unit and a relay unit are connected by two pipings, and in which a hot water supply function can be readily added. The relay unit includes a connection circuit between a first branching unit and a second connecting piping that is capable of connecting a water heat exchanger that exchanges heat between a refrigerant and water.

15 Claims, 29 Drawing Sheets

(56) References Cited

U.S. PATENT DOCUMENTS

| | | | | |
|---|---|---|---|---|
| 2005/0066678 | A1* | 3/2005 | Kamimura | F25B 29/003 62/238.7 |
| 2005/0167516 | A1* | 8/2005 | Saitoh | F24D 17/02 237/2 B |
| 2006/0005558 | A1* | 1/2006 | Otake | F25B 9/008 62/260 |
| 2007/0199337 | A1* | 8/2007 | Otake | F24D 17/02 62/183 |
| 2007/0246555 | A1* | 10/2007 | Nishimura | F24D 3/08 237/2 B |
| 2009/0113911 | A1* | 5/2009 | Nakayama | F24D 17/02 62/238.6 |
| 2009/0211282 | A1* | 8/2009 | Nishimura | F24D 17/02 62/238.6 |
| 2010/0050675 | A1* | 3/2010 | Kameyama | F24D 17/001 62/238.7 |
| 2010/0229583 | A1* | 9/2010 | Komori | F24D 3/08 62/238.7 |
| 2010/0287964 | A1* | 11/2010 | Okamoto | 62/224 |

FOREIGN PATENT DOCUMENTS

| | | | |
|---|---|---|---|
| JP | 07 19664 | | 1/1995 |
| JP | 07-019664 | A * | 1/1995 |
| JP | 07019664 | A * | 1/1995 |
| JP | 08 261599 | | 10/1996 |
| JP | 2004 44948 | | 2/2004 |
| JP | 2004-044948 | * | 2/2004 |
| JP | 2004 226018 | | 8/2004 |
| JP | 2005 106360 | | 4/2005 |
| WO | 2006 057141 | | 6/2006 |
| WO | 2008 117408 | | 10/2008 |
| WO | WO 2009090860 | A1 * | 7/2009 |
| WO | WO 2009-122476 | A1 | 10/2009 |

OTHER PUBLICATIONS

Combined Chinese Office Action and Search Report issued Nov. 5, 2013, in Chinese Patent Application No. 200980162074.2 with English translation and English translation of category of cited documents.

International Search Report issued on Jan. 19, 2010 in PCT/JP09/068256 filed on Oct. 23, 2009.

Extended European Search Report issued Jun. 23, 2016 in European Patent Application No. 09850593.6.

* cited by examiner

AIR CONDITIONING APPARATUS

TECHNICAL FIELD

The present invention relates to an air-conditioning apparatus in which a heat source unit and a relay unit, as well as the relay unit and a plurality of indoor units that individually carries out cooling or heating are each connected with two refrigerant pipings.

BACKGROUND ART

As described in Patent Literature 1, hitherto, there is an air-conditioning apparatus, which uses a refrigerant that works under a supercritical state, in which a heat source unit and a relay unit, as well as the relay unit and a plurality of indoor units that individually carries out cooling or heating are each connected with two refrigerant pipings. Further, in an air-conditioning apparatus of Patent Literature 2, a load side refrigerant circuit is installed to the same circuit as Patent Literature 1 to heat or cool water to be supplied.

Furthermore, in an air-conditioning apparatus that uses a refrigerant that works under a supercritical state, that has a heat source unit and a plurality of indoor units connected by a high pressure pipe, a low-pressure pipe, and a liquid pipe, and in which the indoor units carry out cooling/heating operation simultaneously, there is one that supplies hot water by allowing direct heat exchange between a refrigerant of the air-conditioning apparatus and water flowing into a water heat exchanger. In an air-conditioning apparatus of Patent Literature 3, a water heat exchanger is disposed in a discharge piping of the compressor, a piping connecting the outlet of the water heat exchanger and the outdoor heat exchanger is connected to a bypass piping that bypasses the outdoor heat exchanger, and control determining whether to bypass the outdoor heat exchanger or not is carried out based on whether the outlet temperature of the water heat exchanger is higher or lower than the outdoor air temperature during a simultaneous cooling and hot water supply operation. Further, during a heating and hot water supply operation, the refrigerant that has performed hot water supply in the water heat exchanger carries out heating in the heating indoor unit. In the air-conditioning apparatus of Patent Literature 4, a heat source unit and a plurality of indoor units are connected by a high-pressure piping, a low-pressure piping, and a liquid piping, and a hot water unit is also connected such that the high-pressure piping and the liquid piping are connected.

CITATION LIST

Patent Literature

Patent Literature 1: WO 2006/057141 (pp. 5 and 6, and FIG. 1)

Patent Literature 2: WO 2008/117408 (pp. 11 to 14, and FIG. 3)

Patent Literature 3: Japanese Unexamined Patent Application Publication No. 2005-106360 (pp. 6 and 7, and FIGS. 1 to 4)

Patent Literature 4: Japanese Unexamined Patent Application Publication No. 2004-226018 (pp. 4 and 5, and FIG. 1)

SUMMARY OF INVENTION

Technical Problem

In the air-conditioning apparatus of Patent Literature 1, a refrigerant circuit to which a hot water supply function can be readily added, regardless of the installation location, and a method of control of such a refrigerant circuit are desired. When attaching a load-side refrigerant circuit as in Patent Literature 2, cost is greatly increased by the addition of the new refrigerant circuit.

Further, when attaching a water heat exchanger to a compressor discharge piping as in Patent Literature 3, the hot water supply function of the air-conditioning apparatus becomes limited to within the heat source unit and a space for a hot water unit in the heat source unit becomes necessary, and it is also necessary to disassemble the heat source unit after product shipment to perform additional work on the discharge piping of the compressor, or a line of models equipped with a hot water unit will be needed.

Furthermore, in Patent Literature 4, by connecting the heat source unit and the relay unit with three pipings, refrigerant that has been discharged from a compressor is allowed to flow directly into a hot water device. However, in Patent Literature 1, there is also an operation mode in which refrigerant discharged from a compressor flows into a hot water device after being cooled in a heat source unit-side heat exchanger. The heat exchange performance of the water heat exchanger in this case deteriorates.

The present invention has been made to overcome the above-described problems, and an object of the invention is to provide an air-conditioning apparatus that is capable of readily adding a hot water supply function while connecting a heat source unit and a relay unit with two pipings.

Solution to Problem

The air-conditioning apparatus of the invention includes a heat source unit including a compressor that compresses a refrigerant, a heat source unit-side heat exchanger, and a first flow switching device that switches a passage of the refrigerant; a plurality of indoor units, each including an indoor unit-side heat exchanger that exchanges heat between the refrigerant and indoor air, and a first flow control device that controls a flow rate of the refrigerant; and a relay unit including a branching device that is connected to the heat source unit by two heat source unit-side refrigerant pipings which are branched to each of the plurality of indoor units and is also connected to each of the plurality of indoor units by two indoor unit-side refrigerant pipings, and a second flow switching device that switches a passage of the refrigerant that flows to each of the indoor units; the air-conditioning apparatus being capable of executing the following modes: a heating operation mode in which a high-temperature, high-pressure refrigerant that has been discharged from the compressor flows into all of the plurality of indoor unit-side heat exchangers to heat indoor air, a cooling operation mode in which a low-temperature, low-pressure refrigerant flows into all of the indoor unit-side heat exchangers to cool indoor air, and a cooling and heating mixed operation mode in which a high-temperature, high-pressure refrigerant that has been discharged from the compressor flows into one or some of the plurality of indoor unit-side heat exchangers to heat indoor air, and a low-temperature, low-pressure refrigerant flows into one or some of the remaining indoor unit-side heat exchangers to cool indoor air, and the relay unit including a connection circuit between the branching device and the indoor unit-side refrigerant pipings, the connection circuit being capable of connecting a water heat exchanger that exchanges heat between the refrigerant and water.

Advantageous Effects of Invention

The air-conditioning apparatus of the invention includes a connection circuit between the branching device and the heat source unit-side refrigerant pipings. The connection circuit is capable of connecting a water heat exchanger that exchanges heat between the refrigerant and water, and thus a hot water supply function can be readily added.

DESCRIPTION OF EMBODIMENTS

Figure 1:
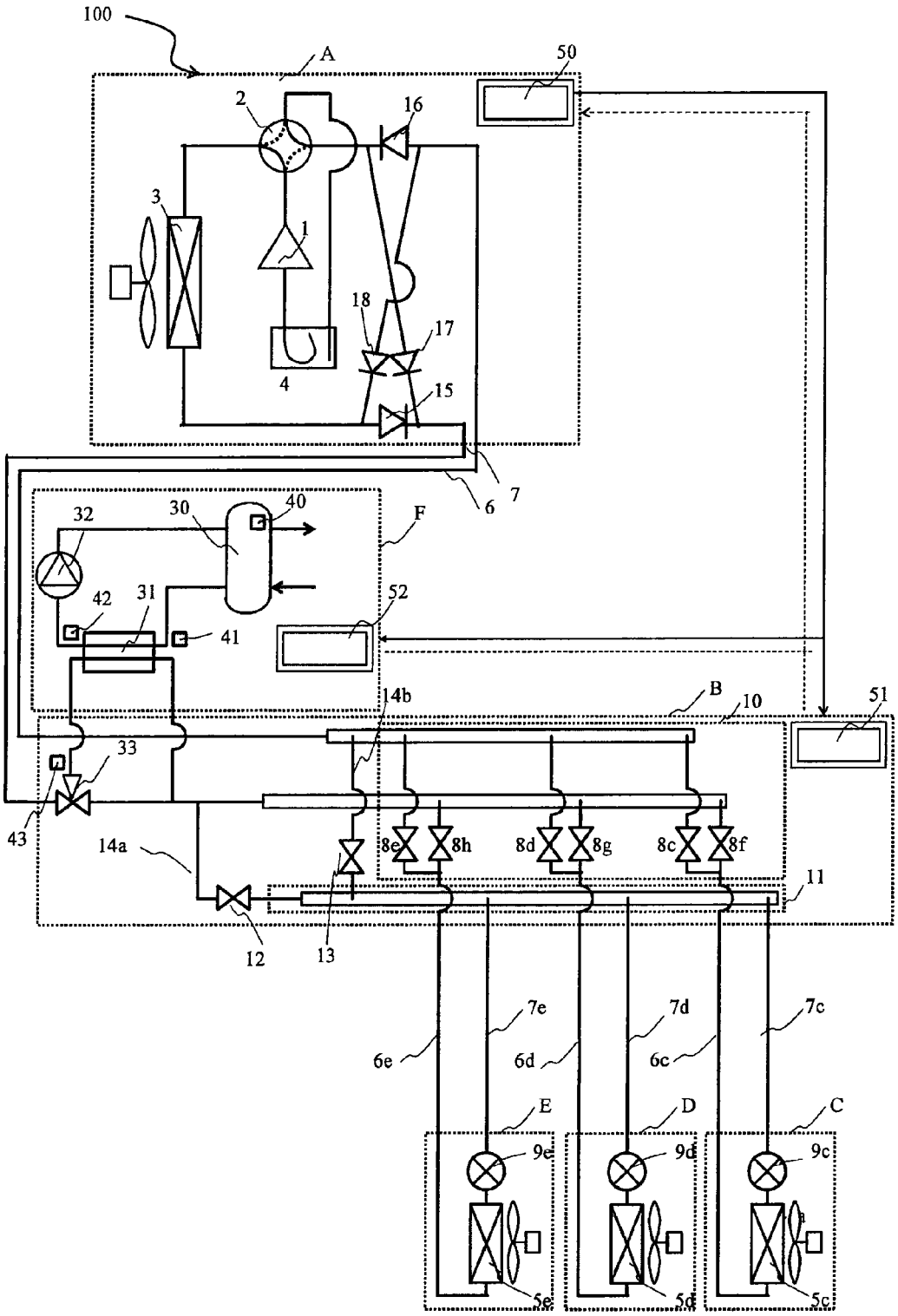
FIG. 1 is a refrigerant circuit diagram showing a refrigerant circuit configuration of an air-conditioning apparatus according to Embodiment 1.

Embodiments of the invention will be described below based on the drawings. In the drawings below, the size relationship of the constituent members may differ from the actual size.

Embodiment 1

FIG. 1 is a refrigerant circuit diagram showing a refrigerant circuit configuration of the air-conditioning apparatus according to Embodiment 1. The circuit configuration of an air-conditioning apparatus 100 will be now be described referring to FIG. 1. In FIG. 1, A is a heat source unit, B is a relay unit, C to E are indoor units connected to each other in parallel, and F is a hot water device. In the refrigerant circuit of the air-conditioning apparatus 100, a refrigerant such as carbon dioxide that operates under a state in which the discharge pressure is higher than its critical pressure is used. In the embodiment, a case in which one relay unit, three indoor units, and one hot water device are connected to one heat source unit is described, but the same description applies when two or more heat source units, two or more relay units, two or more indoor units, and two or more hot water devices are connected.

The heat source unit A is equipped with a compressor 1, a four-way switching valve 2 that is a switching valve for switching the direction of refrigerant flow in the heat source unit, an outdoor heat exchanger 3 that is a heat source unit-side heat exchanger, and an accumulator 4. The compressor 1 sucks in refrigerant and compresses it to a refrigerant of a high-temperature, high-pressure state, and the compressor 1 can be constituted by, for example, an inverter compressor capable of capacity control. The four-way switching valve 2 switches between a refrigerant flow during a heating operation (a heating only operation mode and a heating main operation mode) and a refrigerant flow during a cooling operation (a cooling only operation mode and a cooling main operation mode). The outdoor heat exchanger 3 functions as an evaporator during the heating operation and functions as a condenser (or radiator) during the cooling operation, and exchanges heat between air supplied from an air-sending device such as a fan and refrigerant to evaporate and gasify the refrigerant or condense and liquefy the refrigerant. The accumulator 4 is provided on the suction side of the compressor 1 and retains excess refrigerant. In the following, as an example of the heat source-side heat exchanger, an air-cooled outdoor heat exchanger 3 will be described, but other types of heat exchangers such as a water-cooled heat exchanger can also be used as long as it can exchange heat between the refrigerant and other fluids.

6 is a wide first connecting piping that connects the four-way switching valve 2 and the relay unit B. 7 is a second connecting piping that is narrower than the first connecting piping 6 and connects the outdoor heat exchanger 3 and the relay unit B. The first and second connecting pipings constitute heat source unit-side refrigerant pipings.

15 is a check valve provided between the outdoor heat exchanger 3 and the second connecting piping 7. The check valve 15 permits the flow of refrigerant only from the outdoor heat exchanger 3 to the second connecting piping 7. 16 is a check valve provided between the four-way switching valve 2 of the heat source unit A and the first connecting piping 6. The check valve 16 permits the flow of refrigerant only from the first connecting piping 6 to the four-way switching valve 2. 17 is a check valve provided between the four-way switching valve 2 of the heat source unit A and the second connecting piping 7. The check valve 17 permits the flow of refrigerant only from the four-way switching valve 2 to the second connecting piping 7. 18 is a check valve provided between the outdoor heat exchanger 3 and the first connecting piping 6. The check valve 18 permits the flow of refrigerant only from the first connecting piping 6 to the outdoor heat exchanger 3. The check valves 15, 16, 17, and 18 and the four-way switching valve 2 constitute a first flow switching device.

The relay unit B is equipped with a first branching unit 10, a second flow control device 12, a second branching unit 11, and a third flow control device 13. The indoor units C, D, and E are respectively equipped with first flow control devices 9*c*, 9*d*, and 9*e* and indoor heat exchangers 5*c*, 5*d*, and 5*e* that are indoor unit-side heat exchangers.

6*c*, 6*d*, and 6*e* are first indoor unit-side connecting pipings that are provided so as to correspond to the indoor units C, D, and E and respectively connect the indoor heat exchangers 5*c*, 5*d*, and 5*e* of the indoor units C, D, and E to the relay unit B. 7*c*, 7*d*, and 7*e* are second indoor unit-side connecting pipings that are provided so as to correspond to the indoor units C, D, and E and respectively connect the first flow control devices 9*c*, 9*d*, and 9*e* of the indoor units C, D, and E to the relay unit B. The first indoor unit-side connecting pipings 6*c*, 6*d*, and 6*e* and the second indoor unit-side connecting pipings 7*c*, 7*d*, and 7*e* constitute indoor unit-side refrigerant pipings.

The first flow control devices 9*c*, 9*d*, and 9*e* have functions of a pressure reducing valve and an expansion valve, and reduce the pressure and expand the refrigerant. The first flow control devices 9*c*, 9*d*, and 9*e* are respectively connected to the second indoor unit-side connecting pipings 7*c*, 7*d*, and 7*e*. The first flow control devices 9*c*, 9*d*, and 9*e* are provided on the upstream side of the indoor heat exchangers 5*c*, 5*d*, and 5*e* in the flow of refrigerant during the cooling operation. The first flow control devices 9*c*, 9*d*, and 9*e* are connected adjacent to the indoor heat exchangers 5*c*, 5*d*, and 5*e*, and are controlled during cooling based on the degree of superheat at the outlet side of the indoor heat exchanger 5 and controlled during heating based on the degree of supercooling. The first flow control devices 9*c*, 9*d*, and 9*e* may preferably be constituted by devices whose opening degree can be variably controlled such as an electronic expansion valve or the like.

The first branching unit 10 includes solenoid valves 8*c*, 8*d*, 8*e*, 8*f*, 8*g*, and 8*h*. The solenoid valves 8*c*, 8*d*, and 8*e* respectively connect the first indoor unit-side connecting pipings 6*c*, 6*d*, and 6*e* and the first connecting piping 6. The solenoid valves 8*f*, 8*g*, and 8*h* respectively connect the first indoor unit-side connecting pipings 6*c*, 6*d*, and 6*e* and the second connecting piping 7. By switching the opening and closing of the solenoid valves 8*c*, 8*d*, 8*e*, 8*f*, 8*g*, and 8*h*, the first indoor unit-side connecting pipings 6*c*, 6*d*, and 6*e* are switchably connected to the first connecting piping 6 or the second connecting piping 7. The second branching unit 11 is constituted by the second indoor unit-side connecting pipings 7*c*, 7*d*, and 7*e*, a first bypass piping 14*a* and a second bypass piping 14*b* in the relay unit B to be described later, and a junction of the above. The first branching unit 10 and the second branching unit 11 constitute a branching device. Instead of the solenoid valves 8*c*, 8*d*, 8*e*, 8*f*, 8*g*, and 8*h*, three-way valves in a number corresponding to the number of indoor units may also be used. In this case, one of the three ways is connected to the first connecting piping 6, one of the three ways is connected to the second connecting piping 7, and the remaining one of the three ways is connected to each of the corresponding first indoor unit-side connecting pipings 6*c*, 6*d*, and 6*e*.

14*a* is a first bypass piping that joins the second connecting piping 7 and the second branching unit 11 in the relay unit B. 14*b* is a second bypass piping that joins the first connecting piping 6 and the second branching unit 11 in the relay unit B. 12 is an openable and closable second flow control device provided in the middle of the first bypass piping 14*a*. 13 is an openable and closable third flow control device provided in the middle of the second bypass piping 14*b*. The second flow control device 12 and the third flow control device 13 are constituted by, for example, two-way valves using a stepping motor, and allow the opening degree of the pipings to be changed to control the flow rate of the refrigerant. The second flow control device 12, the third flow control device 13, the first bypass piping 14*a*, the second bypass piping 14*b*, and the solenoid valves 8*c*, 8*d*, 8*e*, 8*f*, 8*g*, and 8*h* constitute a second flow switching device.

In addition, control means 50 of the heat source unit, which is a heat source unit-side control device, and control means 51 of the relay unit are provided in the air-conditioning apparatus 100. Although a detailed description of detectors will be omitted, the control means 50 and 51 control the driving of the compressor 1, the switching of the four-way switching valve 2, the driving of a fan motor of an outdoor fan, the opening degrees of the flow control devices, and the driving of a fan motor of an indoor fan, based on information (refrigerant pressure information, refrigerant temperature information, outdoor temperature information, and indoor temperature information) detected by various detectors disposed in the air-conditioning apparatus 100. The control means 50 and 51 are constituted by microcomputers or the like, and include memories 50*a* and 51*a* in which functions for determining each control value and the like are stored.

By the above-described control method, the frequency of the compressor 1 of the heat source unit A and the heat exchange rate of the outdoor heat exchanger 3 are controlled so that the indoor units C, D, and E perform a predetermined cooling or heating.

In the hot water device F, a hot water tank 30, a water heat exchanger 31 that exchanges heat between water and the refrigerant, and a pump 32 that drives the water are installed. In the upper portion of the hot water tank 30, a hot water intake is provided. An inlet for hot water returning from the water heat exchanger 31 is provided on the other side of the upper portion of the tank. In the lower portion of the tank, a water supply port for supplying water to the tank is provided. On the other side of the lower portion of the tank, an outlet for supplying water in the tank to the water heat exchanger 31 is provided. From the outlet of the hot water tank 30, a water piping is formed so as to circularly connect the water heat exchanger 31, the pump 32, and the inlet of the hot water tank. The pump 32 can also be disposed between the tank outlet and the water heat exchanger 31.

A flow switching valve 33 that switches the flow of the refrigerant to the hot water device F is provided in the relay unit B. The flow switching valve 33 is constituted by a three-way valve or the like, and switches the passage of the refrigerant. In the flow switching valve 33, one of the three ways is connected to the heat source unit side of the second connecting piping 7, one of the three ways is connected to the refrigerant inlet side of the water heat exchanger 31, and the remaining one of the three ways is connected to the first branching unit 10 side of the second connecting piping 7. A return piping 36*a* that connects the refrigerant outlet side of the water heat exchanger 31 of the hot water device F and the second connecting piping 7 is also provided. The flow switching valve 33 and the return piping 36*a* constitute a connection circuit. By this connection circuit, the water heat exchanger 31 of the hot water device F can be connected between the branching device and the second connecting piping 7. The flow switching valve 33 is not limited to a three-way valve, and any constitution can be used as long as the passages can be switched, for example, a combination of two valves that open/close two passages such as a two-way valve.

As will be described later, when hot water is supplied while there is an indoor unit in heating, the water heat exchanger 31 will be disposed upstream of the indoor unit during the heating operation. Note that a flow control device 34 can be provided to the return piping 36*a*. If the flow control device 34 is provided, the hot water circuit can be shut off. Accordingly, the portion that is needed to be vacuumed during the additional work for the hot water device F will only be between the flow switching valve 33 and the flow control device 34, thus construction can be facilitated.

A tank inner temperature detector 40 that measures the temperature in the hot water tank 30 is provided to the hot water device F. A water temperature detector 41, which is a water temperature detection device, is provided on the piping between the outlet of the hot water tank 30 and the inlet of the water heat exchanger 31. A water temperature detector 42, which is a water temperature detection device, is provided in the piping between the outlet of the water heat exchanger 31 and the inlet of the hot water tank 30. The tank inner temperature detector 40 and the water temperature detectors 41 and 42 can be constituted by, for example, thermistors or the like. A refrigerant temperature detector 43 is provided near the flow switching valve 33 of the relay unit B. The refrigerant temperature detector 43 measures the temperature of the refrigerant in the inlet of the water heat exchanger 31. The refrigerant temperature detector 43 can be constituted by, for example, a thermistor or the like. Further, control means 52 of the hot water device, which is a hot water device-side control device, is provided. The control means 52 controls the drive voltage or the like of the pump 32 based on a difference from a target value of the temperature in the hot water tank 30, the temperature difference of the water temperature detectors 41 and 42 at the outlet and inlet of the water heat exchanger, or an indicated value of the water temperature detector 42 at the outlet of the water heat exchanger, and thereby the flow rate of the pump 32 is controlled. Alternatively, the control means 52 controls the drive voltage or the like of the pump 32 to control the flow rate of the pump 32 to be constant. The control means 52 is constituted by a microcomputer or the like, and includes a memory 52*a* in which functions for determining each control value and the like are stored.

Various operations executed by the air-conditioning apparatus 100 will now be described. The operations of the air-conditioning apparatus 100 includes the four modes, namely, the cooling operation, the heating operation, the cooling main operation, and the heating main operation that are in accordance with the settings of the cooling operation and the heating operation of the indoor units. In each operation mode, there are cases in which hot water is supplied and is not supplied.

The cooling operation is an operation mode in which the indoor units are only capable of cooling, and the indoor units are either cooling or stopped. The heating operation is an operation mode in which the indoor units are only capable of heating, and the indoor units are either heating or stopped. The cooling main operation, which is a cooling and heating mixed operation mode, is an operation mode in which cooling or heating is selected for each indoor unit, the cooling load is larger than the heating load (the sum of the cooling load and the compressor input is larger than the heating load), and the outdoor heat exchanger 3 is connected to the discharge side of the compressor 1 and functions as a radiator (condenser). The heating main operation, which is a cooling and heating mixed operation mode, is an operation mode in which cooling or heating is selected for each indoor unit, the heating load is larger than the cooling load (the heating load is larger than the sum of the cooling load and the compressor input), and the outdoor heat exchanger 3 is connected to the suction side of the compressor 1 and functions as an evaporator. The refrigerant flow in each operation mode will be described below together with P-h diagrams.

[Cooling Operation]

(i) Case when Hot Water is not Supplied

Figure 2:
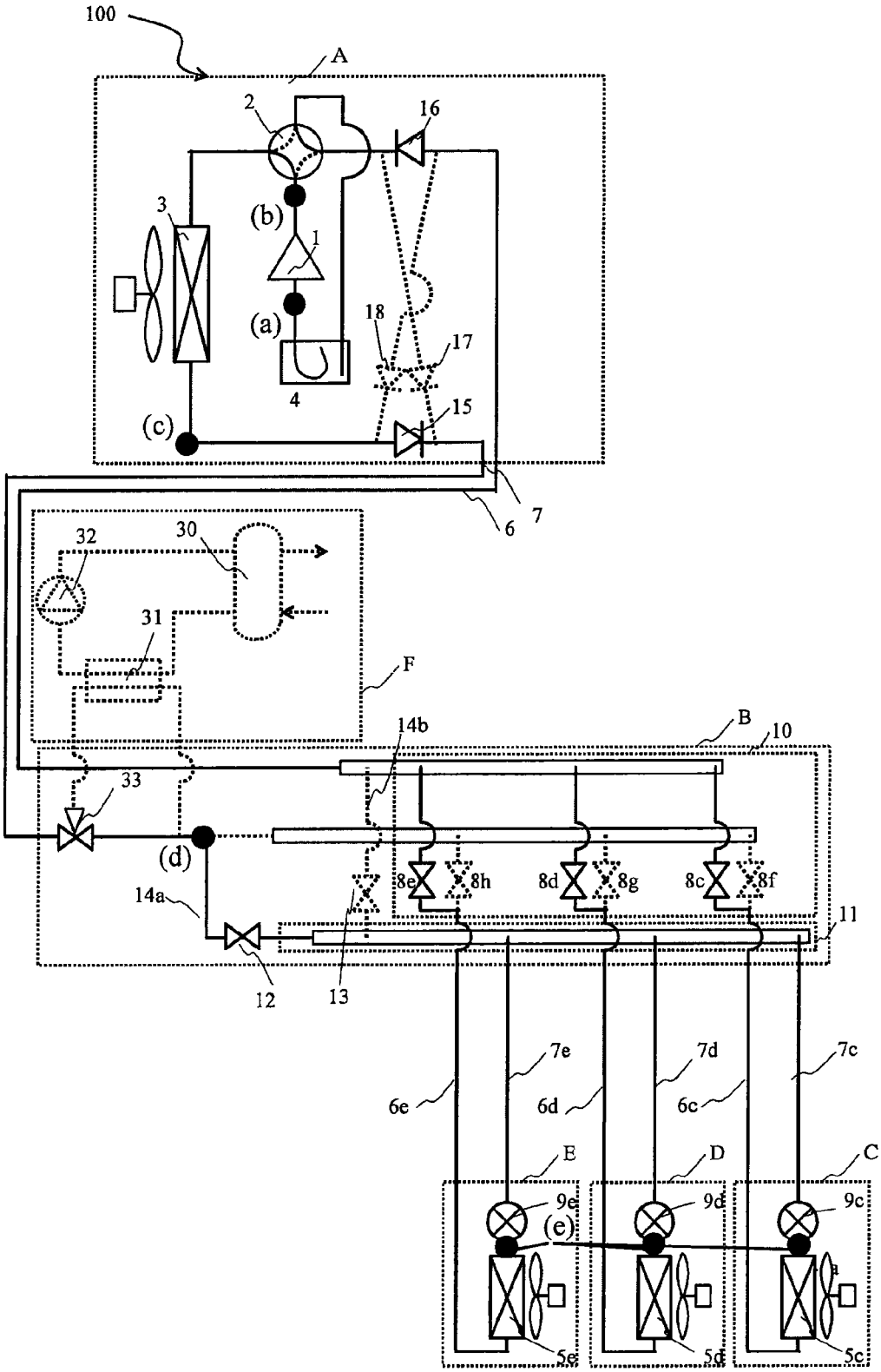
FIG. 2 is a refrigerant circuit diagram showing a flow of refrigerant during a cooling operation of the air-conditioning apparatus according to Embodiment 1.
Figure 3:
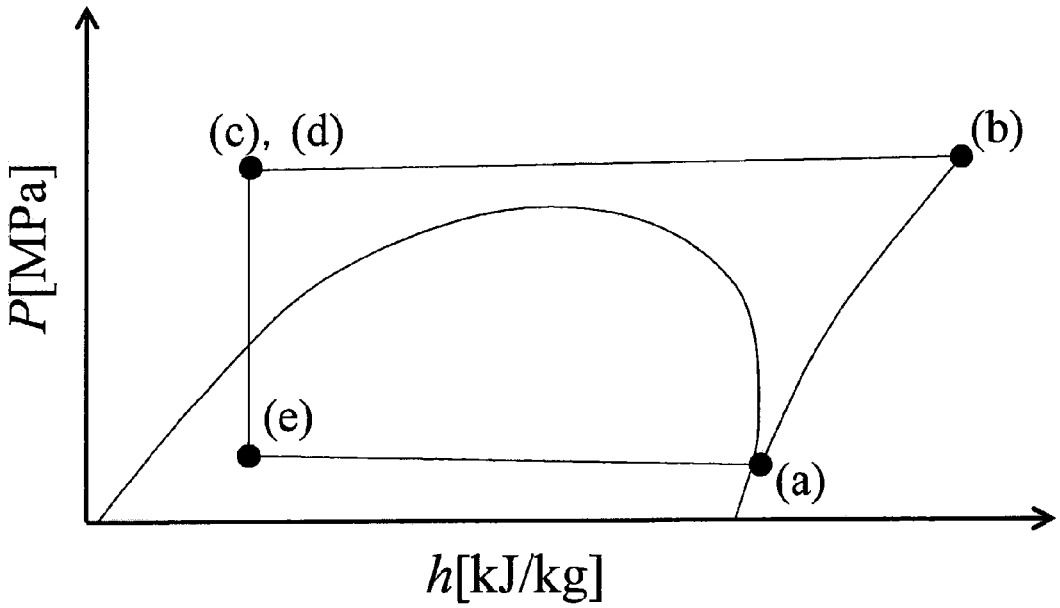
FIG. 3 is a P-h diagram during the cooling operation of the air-conditioning apparatus according to Embodiment 1.

FIG. 2 is a refrigerant circuit diagram showing the flow of the refrigerant during the cooling operation of the air-conditioning apparatus according to Embodiment 1. The following description applies to a case in which all of the indoor units C, D, and E are about to perform cooling. When performing cooling, the four-way switching valve 2 is switched so that the refrigerant discharged from the compressor 1 flows into the outdoor heat exchanger 3. The solenoid valves 8*c*, 8*d*, and 8*e* connected to the indoor units C, D, and E are opened, and the solenoid valves 8*f*, 8*g*, and 8*h* are closed. The pipings shown in bold lines in FIG. 2 are pipings in which refrigerant circulates. FIG. 3 is a P-h diagram during the cooling operation of the air-conditioning apparatus according to Embodiment 1. The refrigerant states of (a) to (e) in FIG. 3 correspond to the refrigerant states shown at the respective locations in FIG. 2.

The operation of the compressor 1 is started in the above-described state. A low-temperature, low-pressure gas refrigerant is compressed by the compressor 1 and is discharged as a high-temperature, high-pressure gas refrigerant. In the refrigerant compression process in the compressor 1, the refrigerant is compressed so that it is heated more than it is adiabatically compressed on an isentropic line by the amount of adiabatic efficiency of the compressor or the like, and this is represented by the line between point (a) and point (b) in FIG. 3.

The high-temperature, high-pressure gas refrigerant that has been discharged from the compressor 1 flows into the outdoor heat exchanger 3 through the four-way switching valve 2. At this time, the refrigerant is cooled while heating the outdoor air, and turns into a middle-temperature, high-pressure liquid refrigerant. Taking the pressure loss of the outdoor heat exchanger 3 into account, the refrigerant change in the outdoor heat exchanger 3 is represented by the slightly inclined straight line that is close to horizontal extending from point (b) to point (c) in FIG. 3.

The middle-temperature, high-pressure liquid refrigerant that has flowed out from the outdoor heat exchanger 3 passes through the second connecting piping 7 and passes through the flow switching valve 33 such that the hot water device F is bypassed. The refrigerant undergoes hardly any change at this time, and reaches the state shown by point (d) in FIG. 3. The refrigerant then passes through the first bypass piping 14*a* and the second flow control device 12, and enters the second branching unit 11 and branches to flow into the first flow control devices 9*c*, 9*d*, and 9*e*. The high-pressure liquid refrigerant is throttled in the first flow control devices 9*c*, 9*d*, and 9*e* and is expanded and decompressed, and then enters a low-temperature low-pressure two-phase gas-liquid state. The refrigerant change in the first flow control devices 9*c*, 9*d*, and 9*e* is carried out under a constant enthalpy. The refrigerant change at this time is represented by the vertical line extending from point (d) to point (e) in FIG. 3.

The low-temperature low-pressure two-phase gas-liquid refrigerant that has left the first flow control devices 9*c*, 9*d*, and 9*e* flows into the indoor heat exchangers 5*c*, 5*d*, and 5*e*. The refrigerant is heated while cooling the indoor air, and turns into a low-temperature, low-pressure gas refrigerant. Taking the pressure loss into account, the refrigerant change in the indoor heat exchangers 5*c*, 5*d*, and 5*e* is represented by the slightly inclined straight line that is close to horizontal extending from point (e) to point (a) in FIG. 3.

The low-temperature, low-pressure gas refrigerant that has left the indoor heat exchangers 5*c*, 5*d*, and 5*e* passes through the solenoid valves 8*c*, 8*d*, and 8*e* and flows into the first branching unit 10. The low-temperature, low-pressure gas refrigerant that has merged in the first branching unit 10 passes through the first connecting piping 6 and the four-way switching valve 2, flows into the compressor 1, and is compressed.

(ii) Case when Hot Water is Supplied

Figure 4:
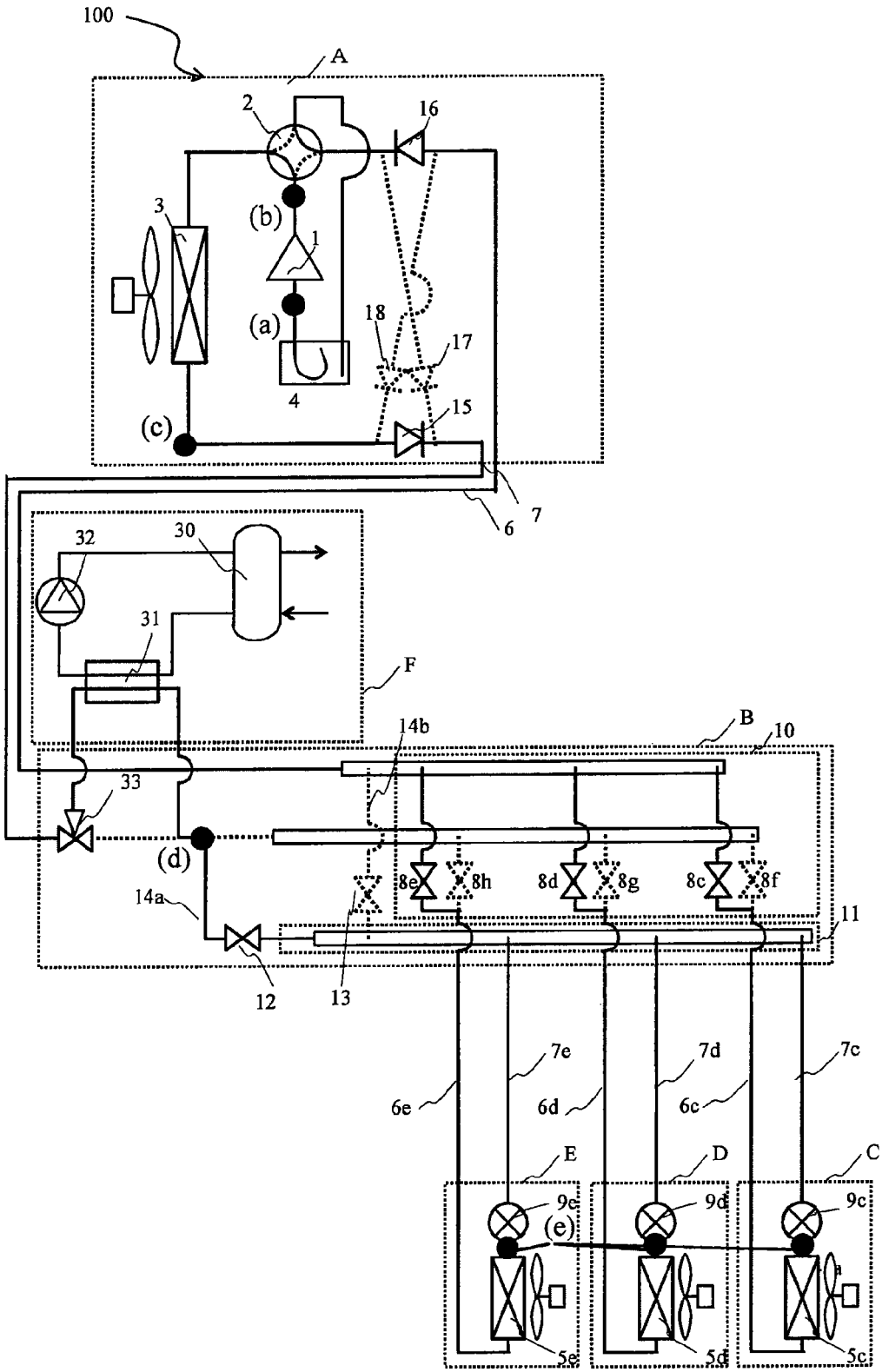
FIG. 4 is a refrigerant circuit diagram showing a flow of refrigerant when hot water is supplied during the cooling operation of the air-conditioning apparatus according to Embodiment 1.
Figure 5:
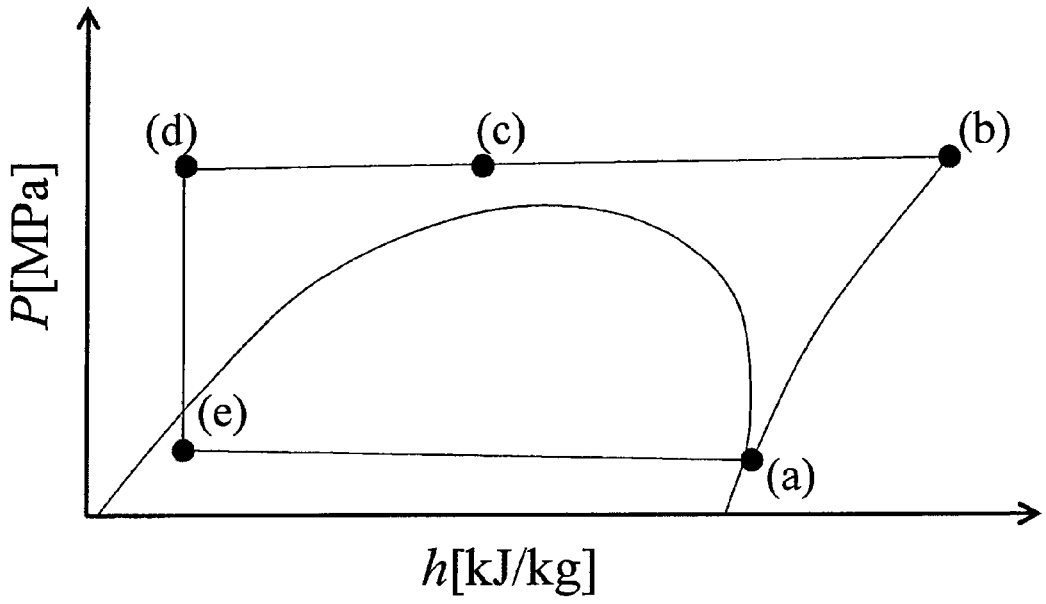
FIG. 5 is a P-h diagram when hot water is supplied during the cooling operation of the air-conditioning apparatus according to Embodiment 1.

FIG. 4 is a refrigerant circuit diagram showing the flow of the refrigerant when hot water is supplied during the cooling operation of the air-conditioning apparatus according to Embodiment 1. FIG. 5 is a P-h diagram when hot water is supplied during the cooling operation of the air-conditioning apparatus according to Embodiment 1. The refrigerant states of (a) to (e) in FIG. 5 correspond to the refrigerant states shown at the respective locations in FIG. 4. When hot water is supplied, the change from (c) to (d) is different from that when hot water was not supplied as described in (i) above. The refrigerant that has flowed out of the heat source unit A and passed through the second connecting piping 7 is made to flow by the flow switching valve 33 into the water heat exchanger 31 for supplying hot water, exchanges heat with water supplied from the hot water tank 30, and is cooled. The change in enthalpy at this time is represented by the slightly inclined straight line that is close to horizontal extending from point (c) to point (d) in FIG. 5.

[Heating Operation]

(i) Case when Hot Water is not Supplied

Figure 6:
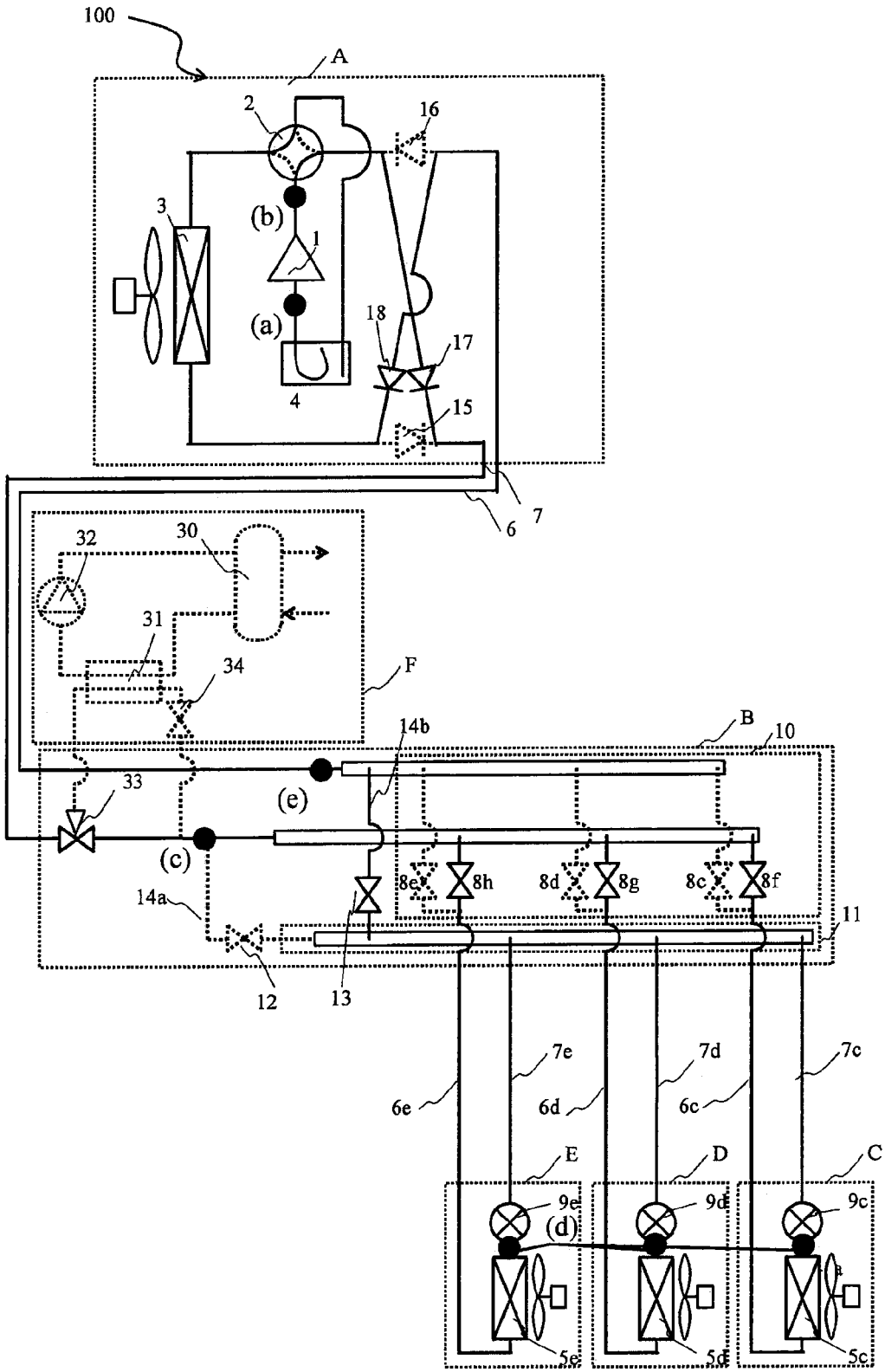
FIG. 6 is a refrigerant circuit diagram showing a flow of refrigerant during a heating operation of the air-conditioning apparatus according to Embodiment 1.
Figure 7:
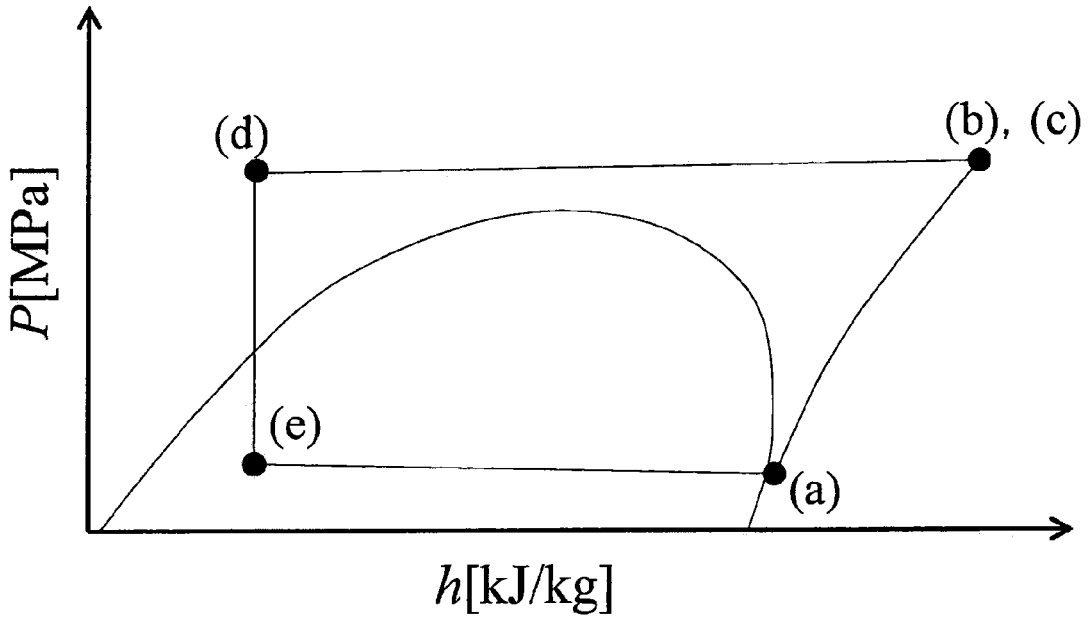
FIG. 7 is a P-h diagram during the heating operation of the air-conditioning apparatus according to Embodiment 1.

FIG. 6 is a refrigerant circuit diagram showing the flow of the refrigerant during the heating operation of the air-conditioning apparatus according to Embodiment 1. The following description applies to a case in which all of the indoor units C, D, and E are about to perform heating. When performing heating, the four-way switching valve 2 is switched so that the refrigerant discharged from the compressor 1 flows into the first branching unit 10. The solenoid valves 8*c*, 8*d*, and 8*e* connected to the indoor units C, D, and E are closed, and the solenoid valves 8*f*, 8*g*, and 8*h* are opened. The pipings shown in bold lines in FIG. 6 are pipings in which refrigerant circulates. FIG. 7 is a P-h diagram during the heating operation of the air-conditioning apparatus according to Embodiment 1. The refrigerant states of (a) to (e) in FIG. 7 correspond to the refrigerant states shown at the respective locations in FIG. 6.

The operation of the compressor 1 is started in the above-described state. A low-temperature, low-pressure gas refrigerant is compressed by the compressor 1 and is discharged as a high-temperature, high-pressure gas refrigerant. This refrigerant compression process in the compressor 1 is represented by the line between point (a) and point (b) in FIG. 7.

The high-temperature, high-pressure gas refrigerant that has been discharged from the compressor 1 passes through the flow switching valve 33 via the four-way switching valve 2 and the second connecting piping 7 such that the hot water device F is bypassed. The refrigerant undergoes hardly any change at this time, and reaches the state shown by point (c) in FIG. 7. Subsequently, the refrigerant branches in the first branching unit 10, passes through the solenoid valves 8*f*, 8*g*, and 8*h* and flows into the indoor heat exchangers 5*c*, 5*d*, and 5*e*. The refrigerant is heated while cooling the indoor air, and turns into a middle-temperature, high-pressure liquid refrigerant. The refrigerant change in the indoor heat exchangers 5*c*, 5*d*, and 5*e* is represented by the slightly inclined straight line that is close to horizontal extending from point (c) to point (d) in FIG. 7.

The middle-temperature, high-pressure liquid refrigerant that has flowed out from the indoor heat exchangers 5*c*, 5*d*, and 5*e* flows into the first flow control devices 9*c*, 9*d*, and 9*e*, merges in the second branching unit 11, and then flows into the third flow control device 13. The high-pressure liquid refrigerant is throttled in the first flow control devices 9*c*, 9*d*, and 9*e* and the third flow control device 13 and is expanded and decompressed, and then enters a low-temperature low-pressure two-phase gas-liquid state. The refrigerant change at this time is represented by the vertical line extending from point (d) to point (e) in FIG. 7.

The low-temperature low-pressure two-phase gas-liquid refrigerant that has left the third flow control device 13 flows into the outdoor heat exchanger 3 through the first connecting piping 6. The refrigerant is heated while cooling the outdoor air, and turns into a low-temperature, low-pressure gas refrigerant. The refrigerant change in the outdoor heat exchanger 3 is represented by the slightly inclined straight line that is close to horizontal extending from point (e) to point (a) in FIG. 7.

The low-temperature, low-pressure gas refrigerant that has left the outdoor heat exchanger 3 passes through the four-way switching valve 2, flows into the compressor 1, and is compressed.

(ii) Case when Hot Water is Supplied

Figure 8:
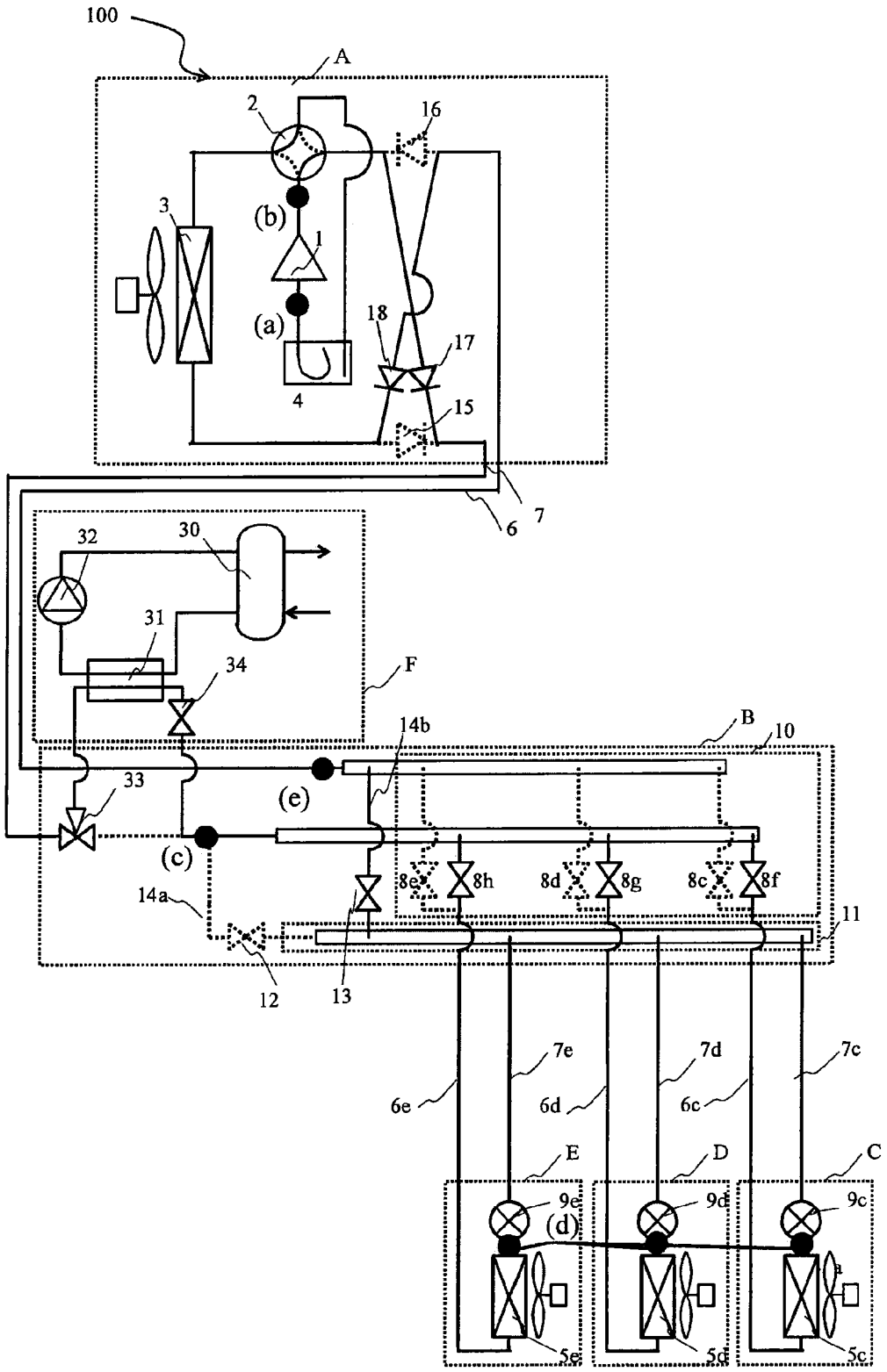
FIG. 8 is a refrigerant circuit diagram showing a flow of refrigerant when hot water is supplied during the heating operation of the air-conditioning apparatus according to Embodiment 1.
Figure 9:
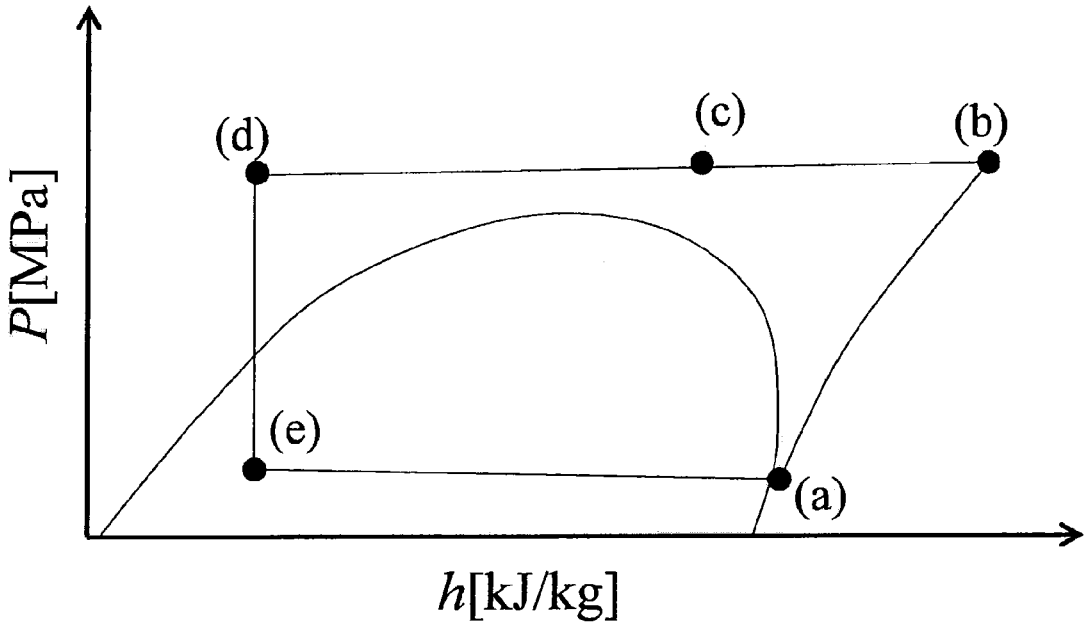
FIG. 9 is a P-h diagram when hot water is supplied during the heating operation of the air-conditioning apparatus according to Embodiment 1.

FIG. 8 is a refrigerant circuit diagram showing the flow of the refrigerant when hot water is supplied during the heating operation of the air-conditioning apparatus according to Embodiment 1. FIG. 9 is a P-h diagram when hot water is supplied during the heating operation of the air-conditioning apparatus according to Embodiment 1. The refrigerant states of (a) to (e) in FIG. 9 correspond to the refrigerant states shown at the respective locations in FIG. 9. When hot water is supplied, the change from (b) to (c) is different from that when hot water was not supplied as described in (i) above. The refrigerant that has flowed out of the heat source unit A and passed through the second connecting piping 7 is made to flow by the flow switching valve 33 into the water heat exchanger 31 for supplying hot water, and then exchanges heat with water supplied from the hot water tank 30, and is cooled. The change in enthalpy at this time is represented by the slightly inclined straight line that is close to horizontal extending from point (b) to point (c) in FIG. 9.

[Cooling Main Operation]

(i) Case when Hot Water is not Supplied

Figure 10:
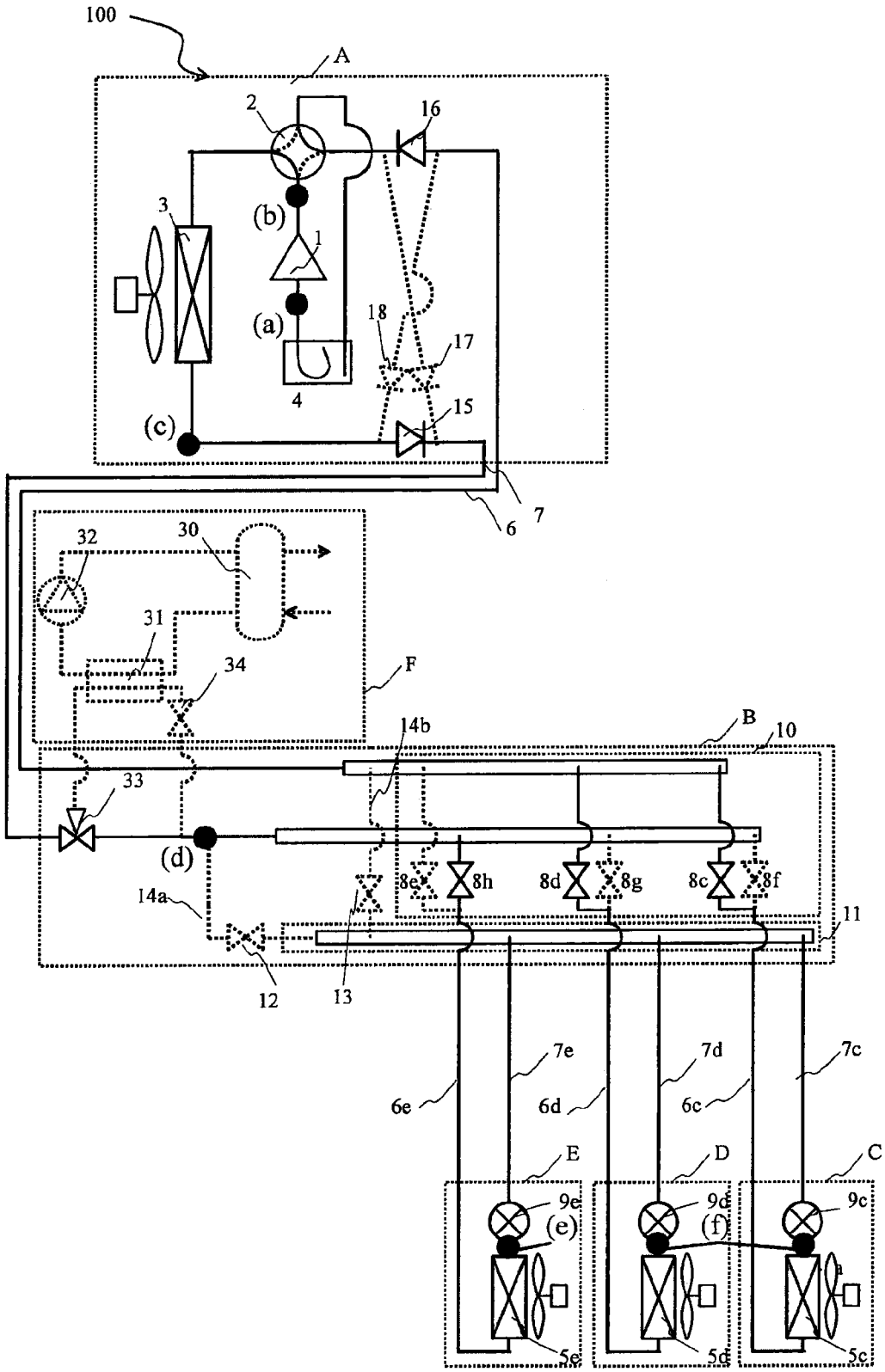
FIG. 10 is a refrigerant circuit diagram showing a flow of refrigerant during a cooling main operation of the air-conditioning apparatus according to Embodiment 1.
Figure 11:
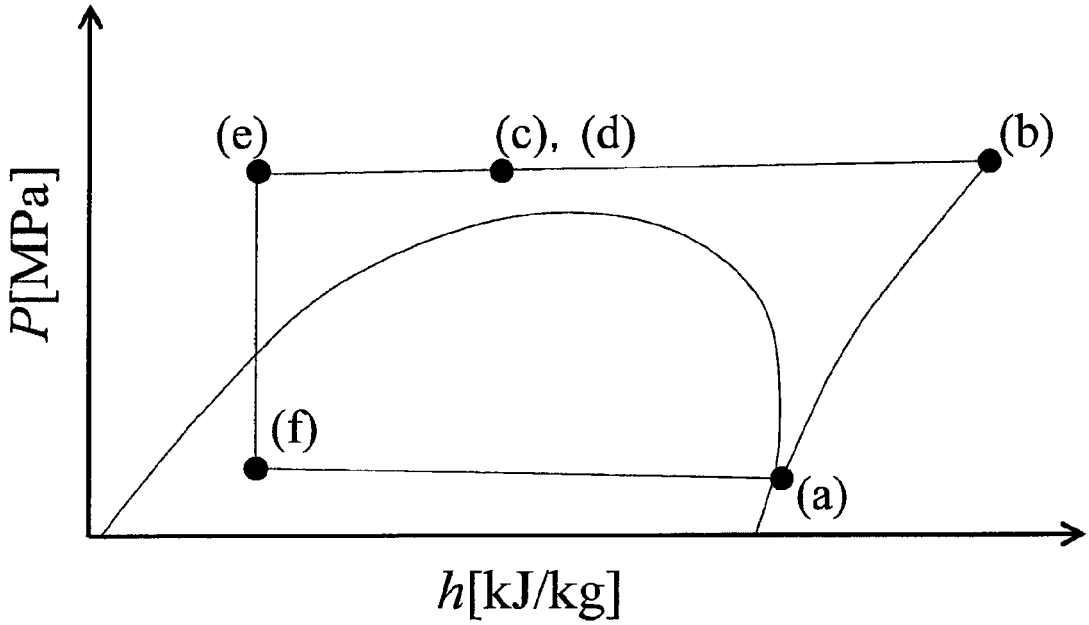
FIG. 11 is P-h diagram during the cooling main operation of the air-conditioning apparatus according to Embodiment 1.

FIG. 10 is a refrigerant circuit diagram showing the flow of the refrigerant during the cooling main operation of the air-conditioning apparatus according to Embodiment 1. The following description applies to a case in which the indoor units C and D are performing cooling operation and the indoor unit E is performing heating operation. In this case, the four-way switching valve 2 is switched so that the refrigerant discharged from the compressor 1 flows into the outdoor heat exchanger 3. The solenoid valves 8*c* and 8*d* connected to the indoor units C and D are opened, and the solenoid valves 8*f* and 8*g* are closed. The solenoid valve 8*e* connected to the indoor unit E is closed, and the solenoid valve 8*h* is opened. The pipings shown in bold lines in FIG. 10 are pipings in which refrigerant circulates. FIG. 11 is P-h diagram during the cooling main operation of the air-conditioning apparatus according to Embodiment 1. The refrigerant states of (a) to (f) in FIG. 11 correspond to the refrigerant states shown at the respective locations in FIG. 11.

The operation of the compressor 1 is started in the above-described state. A low-temperature, low-pressure gas refrigerant is compressed by the compressor 1 and discharged as a high-temperature, high-pressure gas refrigerant. This refrigerant compression process in the compressor 1 is represented by the line between point (a) and point (b) in FIG. 11.

The high-temperature, high-pressure gas refrigerant that has been discharged from the compressor 1 flows into the outdoor heat exchanger 3 through the four-way switching valve 2. At this time, in the outdoor heat exchanger 3, the refrigerant is cooled while heating the outdoor air, leaving an amount of heat necessary for heating, and the refrigerant turns into a middle-temperature, high-pressure refrigerant. The refrigerant change in the outdoor heat exchanger 3 is represented by the slightly inclined straight line that is close to horizontal extending from point (b) to point (c) in FIG. 11.

The middle-temperature, high-pressure refrigerant that has flowed out from the outdoor heat exchanger 3 passes through the second connecting piping 7 and passes through the flow switching valve 33 such that the hot water device F is bypassed. The refrigerant undergoes hardly any change at this time, and reaches the state shown by point (d) in FIG. 11. The refrigerant then flows into the indoor heat exchanger 5*e* that is performing heating through the first branching unit 10 and the solenoid valve 8*h*. The refrigerant is cooled while heating the indoor air, and turns into a middle-temperature, high-pressure gas refrigerant. The refrigerant change in the indoor heat exchanger 5*e* is represented by the slightly inclined straight line that is close to horizontal extending from point (d) to point (e) in FIG. 11.

The refrigerant that has flowed out of the indoor heat exchanger 5*e* that is performing heating passes through the first flow control device 9*e*, branches in the second branching unit 11, and flows into the first flow control devices 9*c* and 9*d* of the indoor units C and E that are performing cooling. The high-pressure liquid refrigerant is throttled in the first flow control devices 9*c* and 9*d* and is expanded and decompressed, and then enters a low-temperature low-pressure two-phase gas-liquid state. The refrigerant change in the first flow control devices 9*c* and 9*d* is carried out under a constant enthalpy. The refrigerant change at this time is represented by the vertical line extending from point (e) to point (f) in FIG. 11.

The low-temperature low-pressure two-phase gas-liquid refrigerant that has left the first flow control devices 9*c* and 9*d* flows into the indoor heat exchangers 5*c* and 5*d*. The refrigerant is heated while cooling the indoor air, and turns into a low-temperature, low-pressure gas refrigerant. The refrigerant change in the indoor heat exchangers 5*c* and 5*d* is represented by the slightly inclined straight line that is close to horizontal extending from point (f) to point (a) in FIG. 11.

The low-temperature, low-pressure gas refrigerant that has left the indoor heat exchangers 5*c* and 5*d* passes through the solenoid valves 8*c* and 8*d* and flows into the first branching unit 10. The low-temperature, low-pressure gas refrigerant that is merged in the first branching unit 10 passes through the first connecting piping 6 and the four-way switching valve 2, flows into the compressor 1, and is compressed.

(ii) Case when Hot Water is Supplied

Figure 12:
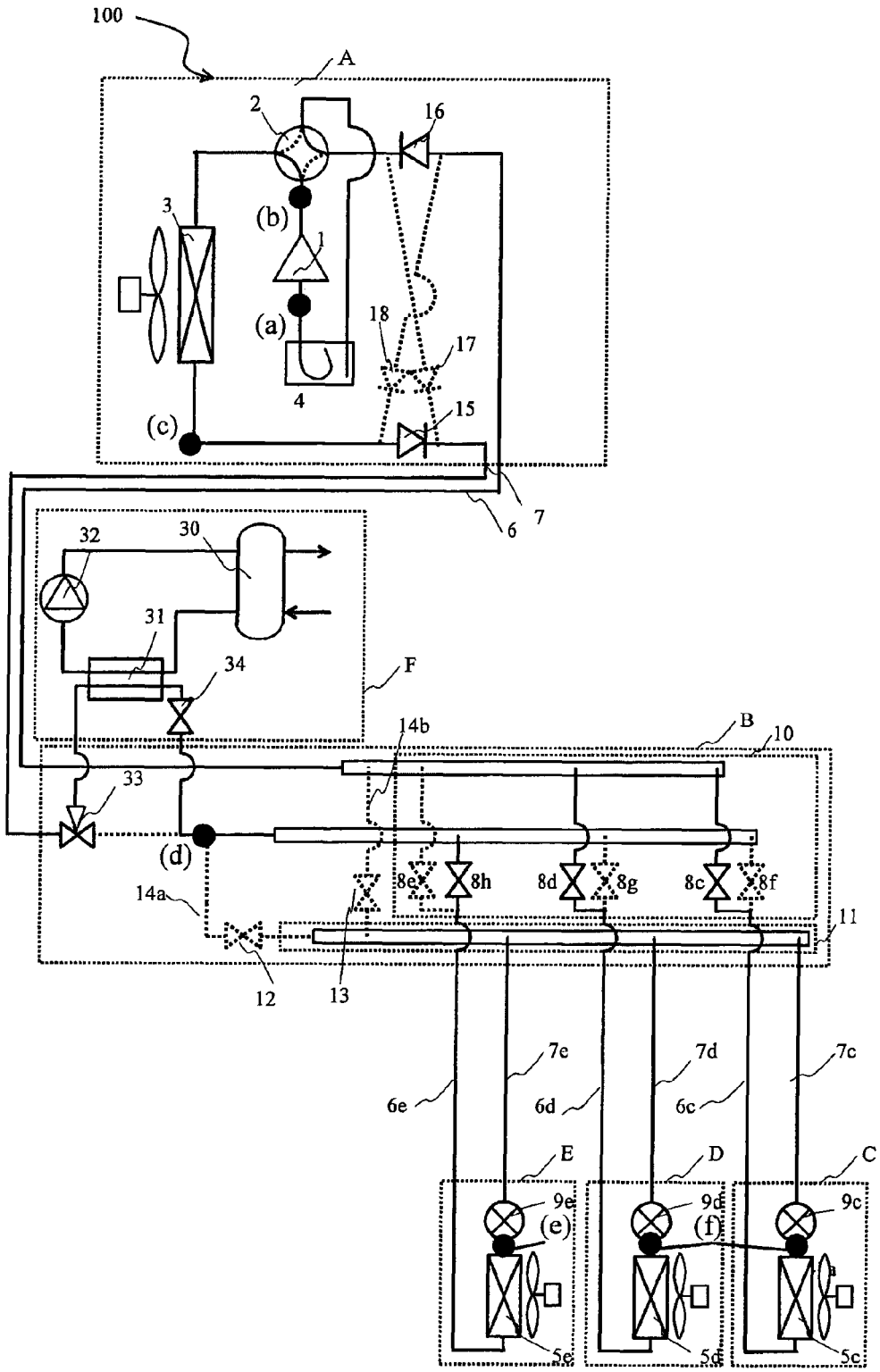
FIG. 12 is a refrigerant circuit diagram showing a flow of refrigerant when hot water is supplied during the cooling main operation of the air-conditioning apparatus according to Embodiment 1.
Figure 13:
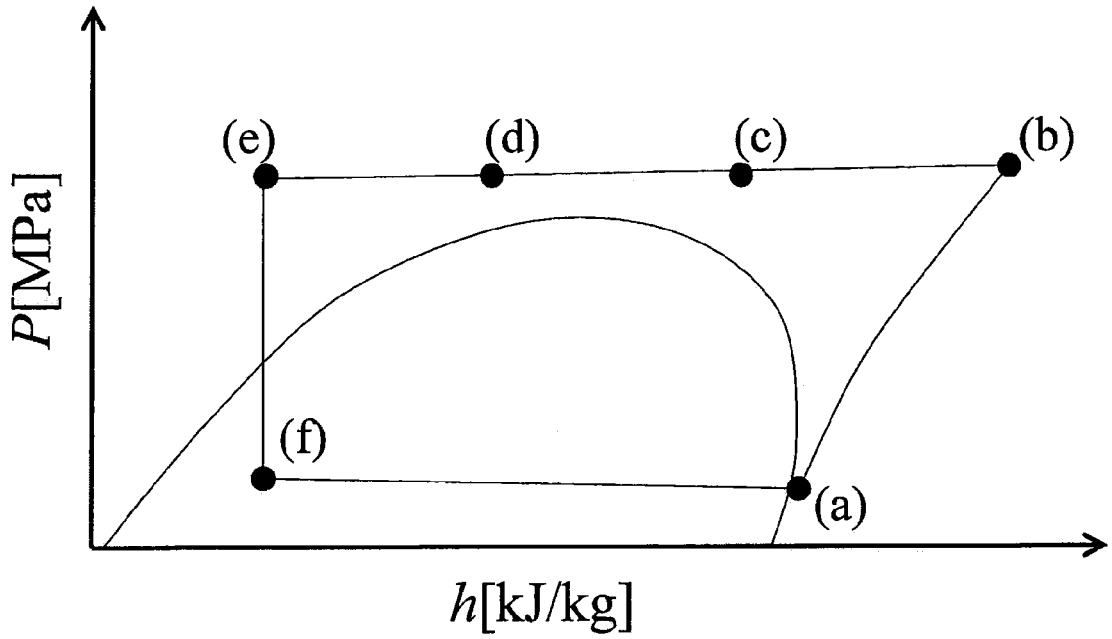
FIG. 13 is P-h diagram when hot water is supplied during the cooling main operation of the air-conditioning apparatus according to Embodiment 1.

FIG. 12 is a refrigerant circuit diagram showing the flow of the refrigerant when hot water is supplied during the cooling main operation of the air-conditioning apparatus according to Embodiment 1. FIG. 13 is a P-h diagram when hot water is supplied during the cooling main operation of the air-conditioning apparatus according to Embodiment 1. The refrigerant states of (a) to (f) in FIG. 13 correspond to the refrigerant states shown at the respective locations in FIG. 12. When hot water is supplied, the change from (c) to (d) is different from that when hot water was not supplied as described in (i) above. The refrigerant that has flowed out of the heat source unit A and passed through the second connecting piping 7 is made to flow by the flow switching valve 33 into the water heat exchanger 31 for supplying hot water, exchanges heat with water supplied from the hot water tank 30, and is cooled. The change in enthalpy at this time is represented by the slightly inclined straight line that is close to horizontal extending from point (c) to point (d) in FIG. 13.

[Heating Main Operation]

(i) Case when Hot Water is not Supplied

Figure 14:
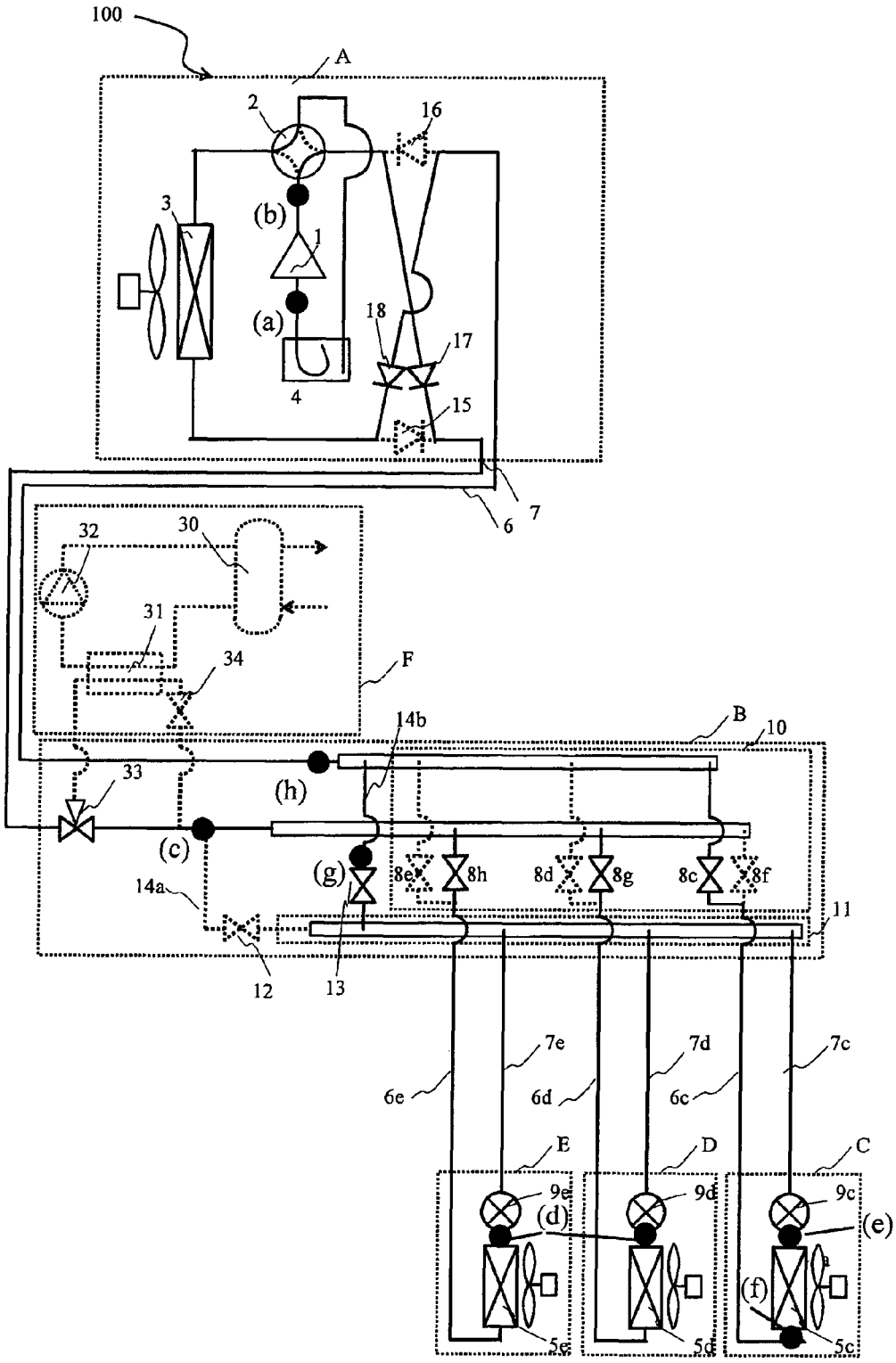
FIG. 14 is a refrigerant circuit diagram showing a flow of refrigerant during a heating main operation of the air-conditioning apparatus according to Embodiment 1.
Figure 15:
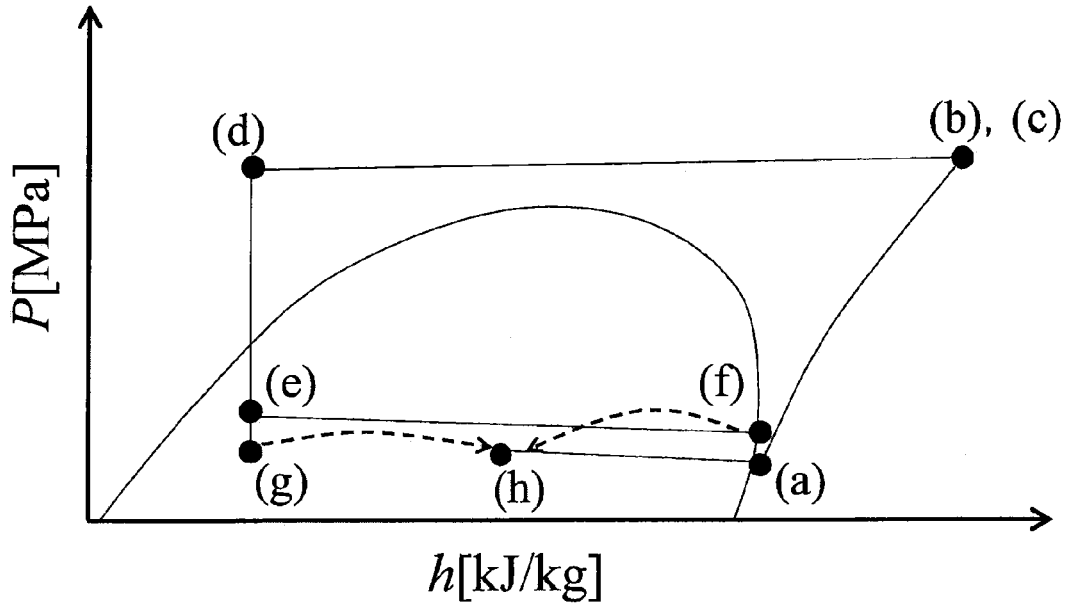
FIG. 15 is P-h diagram during the heating main operation of the air-conditioning apparatus according to Embodiment 1.

FIG. 14 is a refrigerant circuit diagram showing the flow of the refrigerant during the heating main operation of the air-conditioning apparatus according to Embodiment 1. The following description applies to a case in which the indoor unit C is performing cooling operation, and the indoor units D and E are performing heating operation. In this case, the four-way switching valve 2 is switched so that refrigerant discharged from the compressor 1 flows into the first branching unit 10. The solenoid valve 8*f* connected to the indoor unit C is closed, and the solenoid valve 8*c* is opened. The solenoid valves 8*g* and 8*h* connected to the indoor units D and E are opened, and the solenoid valves 8*d* and 8*e* are closed. The pipings shown in bold lines in FIG. 14 are pipings in which refrigerant circulates. FIG. 15 is a P-h diagram during the heating main operation of the air-conditioning apparatus according to Embodiment 1. The refrigerant states of (a) to (h) in FIG. 15 correspond to the refrigerant states shown at the respective locations in FIG. 14.

The operation of the compressor 1 is started in the above-described state. A low-temperature, low-pressure gas refrigerant is compressed by the compressor 1 and discharged as a high-temperature, high-pressure gas refrigerant. This refrigerant compression process in the compressor 1 is represented by the line between point (a) and point (b) in FIG. 15.

The high-temperature, high-pressure gas refrigerant that has been discharged from the compressor 1 passes through the flow switching valve 33 via the four-way switching valve 2 and the second connecting piping 7 such that the hot water device F is bypassed. The refrigerant undergoes hardly any change at this time, and reaches the state shown by point (c) in FIG. 15. Subsequently, the high-temperature, high-pressure gas refrigerant that has flowed into the first branching unit 10 branches in the first branching unit 10, passes through the solenoid valves 8*g* and 8*h* and flows into the indoor heat exchangers 5*d* and 5*e* that are performing heating. The refrigerant is cooled while heating the indoor air, and turns into a middle-temperature, high-pressure liquid refrigerant. The refrigerant change in the indoor heat exchangers 5*d* and 5*e* is represented by the slightly inclined straight line that is close to horizontal extending from point (c) to point (d) in FIG. 14.

The middle-temperature, high-pressure liquid refrigerant that has flowed out from the indoor heat exchangers 5*d* and 5*e* flows into the first flow control devices 9*d* and 9*e* and merges in the second branching unit 11. A portion of the high-pressure liquid refrigerant that has merged in the second branching unit 11 flows into the first flow control device 9*c* that is connected to the indoor unit C that is performing cooling. The high-pressure liquid refrigerant is throttled in the first flow control device 9*c* and is expanded and decompressed, and then enters a low-temperature low-pressure two-phase gas-liquid state. The refrigerant change at this time is represented by the vertical line extending from point (d) to point (e) in FIG. 15. The low-temperature low-pressure two-phase gas-liquid refrigerant that has left the first flow control device 9*c* flows into the indoor heat exchanger 5*c* that is performing cooling. The refrigerant is heated while cooling the indoor air and turns into a low-temperature, low-pressure gas refrigerant. The refrigerant change at this time is represented by the slightly inclined straight line that is close to horizontal extending from point (e) to point (f) in FIG. 15. The low-temperature, low-pressure gas refrigerant that has left the indoor heat exchanger 5*c* passes through the solenoid valve 8*c* and flows into the first connecting piping 6.

Meanwhile, the remainder of the high-pressure liquid refrigerant that has flowed into the second branching unit 11 from the indoor heat exchangers 5*d* and 5*e* that are performing heating flows into the third flow control device 13. The high-pressure liquid refrigerant is throttled in the third flow control device 13 and is expanded (decompressed), and then enters a low-temperature low-pressure two-phase gas-liquid state. The refrigerant change at this time is represented by the vertical line extending from point (d) to point (g) in FIG. 15. The low-temperature low-pressure two-phase gas-liquid refrigerant that has left the third flow control device 13 flows into the first connecting piping 6 and merges with the low-temperature, low-pressure vaporous refrigerant that has flowed in from the indoor heat exchanger 5*c* that is performing cooling (point (h)).

The low-temperature low-pressure two-phase gas-liquid refrigerant that has merged in the first connecting piping 6 flows into the outdoor heat exchanger 3. The refrigerant removes heat from the outdoor air and turns into a low-temperature, low-pressure gas refrigerant. The refrigerant change at this time is represented by the slightly inclined straight line that is close to horizontal extending from point (h) to point (a) in FIG. 15. The low-temperature, low-pressure gas refrigerant that has left the outdoor heat exchanger 3 passes through the four-way switching valve 2, flows into the compressor 1, and is compressed.

(ii) Case when Hot Water is Supplied

Figure 16:
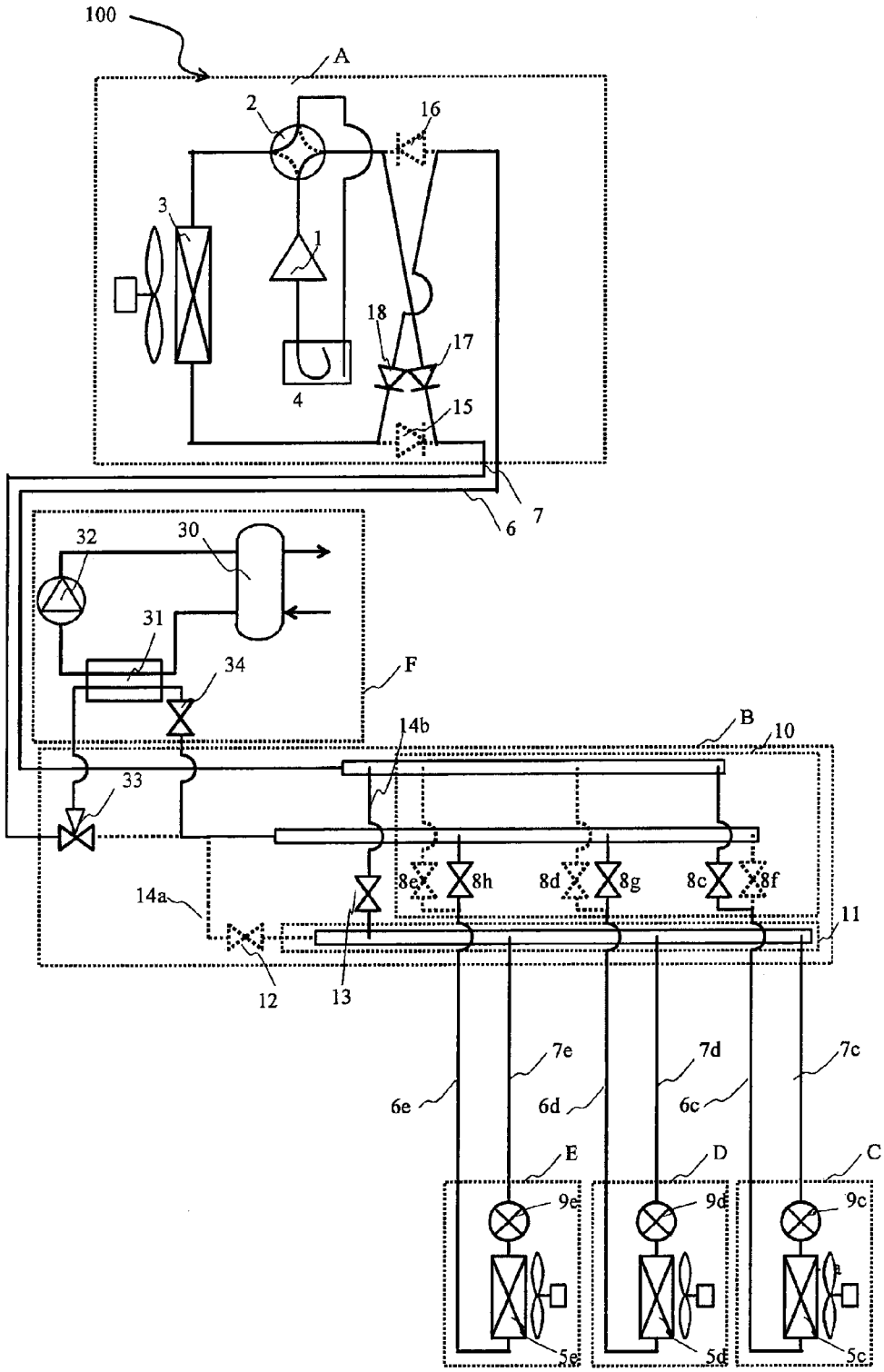
FIG. 16 is a refrigerant circuit diagram showing a flow of refrigerant when hot water is supplied during the heating main operation of the air-conditioning apparatus according to Embodiment 1.
Figure 17:
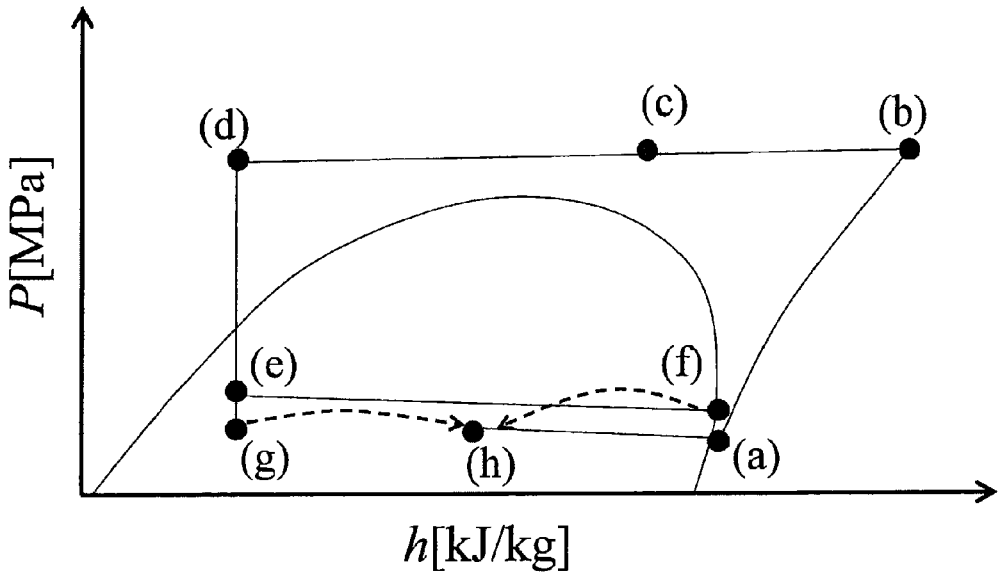
FIG. 17 is P-h diagram when hot water is supplied during the heating main operation of the air-conditioning apparatus according to Embodiment 1.

FIG. 16 is a refrigerant circuit diagram showing the flow of the refrigerant when hot water is supplied during the heating main operation of the air-conditioning apparatus according to Embodiment 1. FIG. 17 is a P-h diagram when hot water is supplied during the heating main operation of the air-conditioning apparatus according to Embodiment 1. The refrigerant states of (a) to (h) in FIG. 16 correspond to the refrigerant states shown at the respective locations in FIG. 17. When hot water is supplied, the change from (b) to (c) is different from that when hot water was not supplied as described in (i) above. The refrigerant that has flowed out of the heat source unit A and passed through the second connecting piping 7 is made to flow by the flow switching valve 33 into the water heat exchanger 31 for supplying hot water, exchanges heat with water supplied from the hot water tank 30, and is cooled. The change in enthalpy at this time is represented by the slightly inclined straight line that is close to horizontal extending from point (b) to point (c) in FIG. 17.

The operation in each operation mode executed by the air-conditioning apparatus 100 has been described above.

The carbon dioxide refrigerant used in the air-conditioning apparatus 100 of the Embodiment 1 has properties in that, under a supercritical state, the density of the refrigerant is high and the specific heat is large compared to chlorofluorohydrocarbon refrigerants. Further, compared to chlorofluorohydrocarbon refrigerants, the specific heat of the gas is large, thus making it possible to discharge high-temperature water during supplying hot water without addition of a load-side refrigerant circuit. By utilizing these properties, the refrigerant can be used in a cascaded manner such that when hot water is supplied during the heating operation or the heating main operation, all of the high-temperature, high-pressure refrigerant discharged from the compressor 1 is made to flow into the water heat exchanger 31 and the refrigerant whose temperature has dropped is used for heating. Thereby, the total performance of heating and hot water supply can be improved.

On the other hand, in the cooling operation or the cooling main operation, the temperature of the refrigerant flowing in the pipings drops in the outdoor heat exchanger 3 near to that of the outdoor air temperature. Therefore, if the hot water supply temperature is higher than the temperature of the refrigerant that is supplied or if high temperature water having a high discharge temperature on the hot water tank side is needed, it will be necessary to raise the temperature of the refrigerant flowing into the hot water device F. Below, two operations for raising the temperature of the inflowing refrigerant in the cooling operation and the cooling main operation will be described.

(1) Raising Temperature of Inflowing Refrigerant in Hot Water Supply Device F by Switching Four-Way Switching Valve 2

Figure 18:
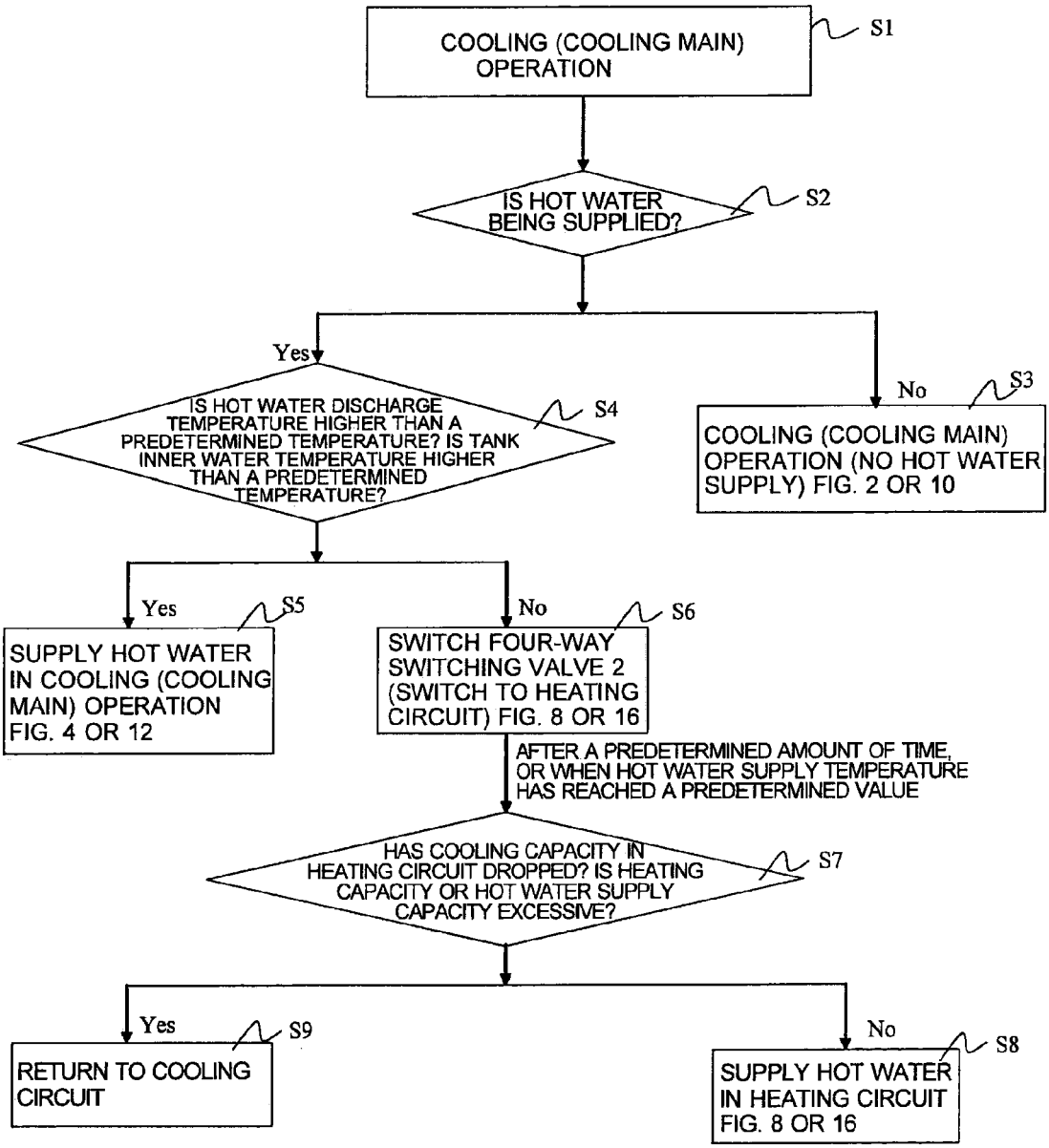
FIG. 18 is a control flowchart for raising the temperature of the refrigerant during the cooling operation and the cooling main operation of the air-conditioning apparatus according to Embodiment 1.

FIG. 18 is a control flowchart for raising the temperature of the refrigerant during the cooling operation and cooling main operation of the air-conditioning apparatus according to Embodiment 1. First, in step 1, control of the cooling operation or cooling main operation is started. In step 2, it is confirmed whether the hot water device F connected to the relay unit B is operating. If hot water is not being supplied, in step 3, the normal cooling operation or cooling main operation is continued (circuit in FIG. 2 or FIG. 10). On the other hand, if hot water is being supplied, in step 4, it is determined whether it is possible to supply hot water with the cooling operation or the cooling main operation from the temperature of water in the hot water tank 30 (indicated value of the tank inner temperature detector 40) or from the hot water discharge temperature of the hot water device F (indicated value of the water temperature detector 42). It can also be determined whether a target hot water discharge is possible by comparing the temperature of the refrigerant (indicated value of the refrigerant temperature detector 43) and the temperature of water (indicated value of the water temperature detector 41) flowing into the water heat exchanger 31. If the water temperature in the hot water tank 30 has reached a predetermined value, for example the tank water temperature has reached a target value, or if the hot water discharge temperature has reached a predetermined value, for example the hot water discharge temperature has reached a target value, it is determined that hot water can be supplied, and in step 5, supply of hot water with the cooling operation or cooling main operation mode (circuit in FIG. 4 or FIG. 12) is continued.

On the other hand, if it is determined that further high-temperature hot water supply is necessary in step 4, in step 6, the control means 52 of the hot water device F sends data related to the current hot water supply status to the control means 50 of the heat source unit A, the control means 50 determines that hot water supply needs be preferentially carried out, and the four-way switching valve 2 is switched to configure a heating circuit. Thereby, the refrigerant discharged from the compressor 1 flows directly into the water heat exchanger 31 (circuits in FIG. 8 or FIG. 16, although the number of indoor units differs from other figures).

Next, after a predetermined amount of time, or if the hot water supply temperature or the temperature in the hot water tank 30 reaches a predetermined value, in step 7, it is determined whether the cooling capacity has dropped below a target value or whether the heating capacity or hot water supply capacity is excessive in the circuit of the heating operation or heating main operation switched in step 6 above. If it is determined that operation is possible with the heating circuit, the operation is continued in step 8. On the other hand, if the cooling capacity has dropped or the like, in step 9, the four-way switching valve 2 is returned to the original cooling circuit and hot water is supplied with the cooling operation or cooling main operation.

Figure 19:
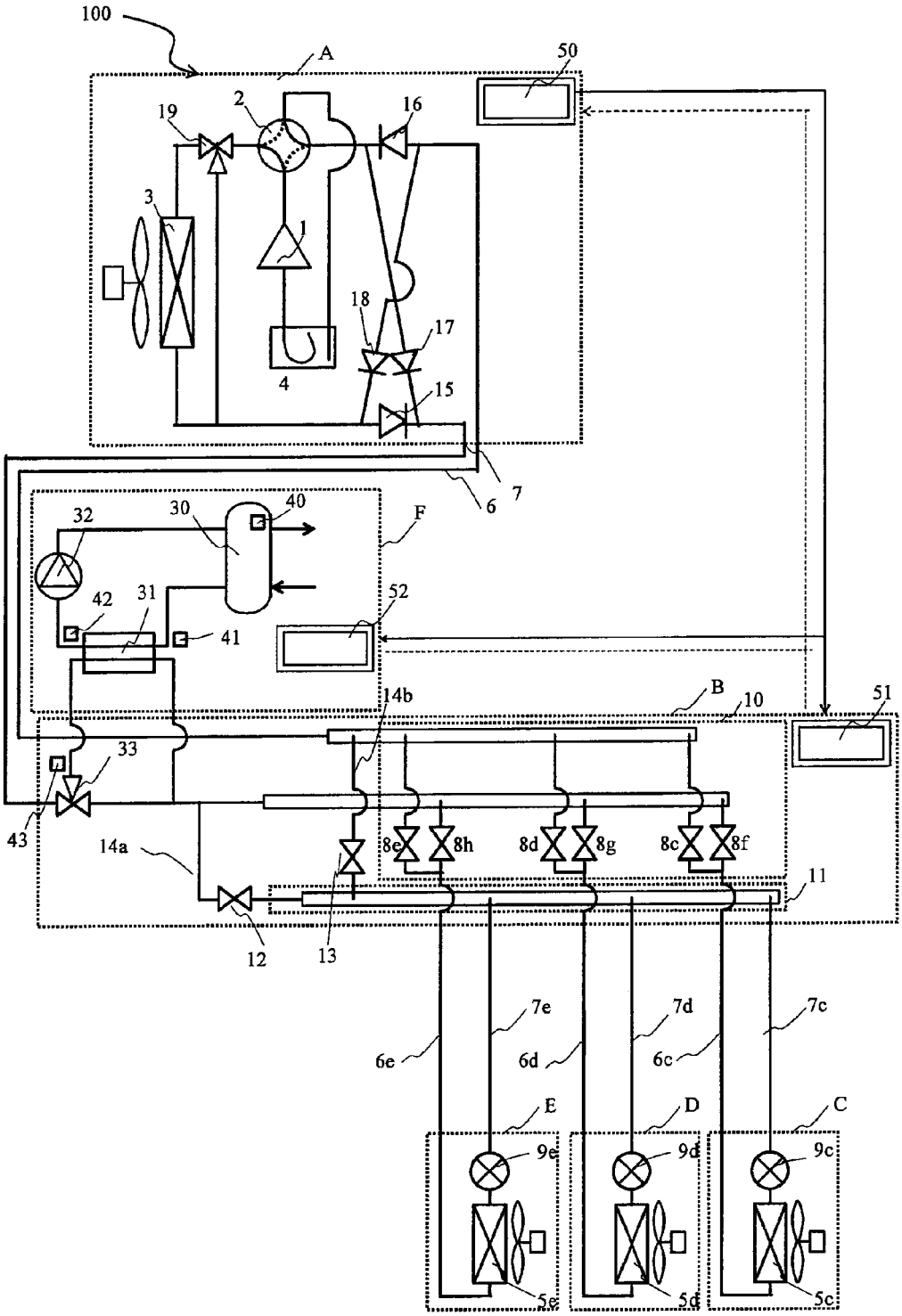
FIG. 19 is a refrigerant circuit diagram in a case in which the outdoor heat exchanger is bypassed in the air-conditioning apparatus according to Embodiment 1.
Figure 20:
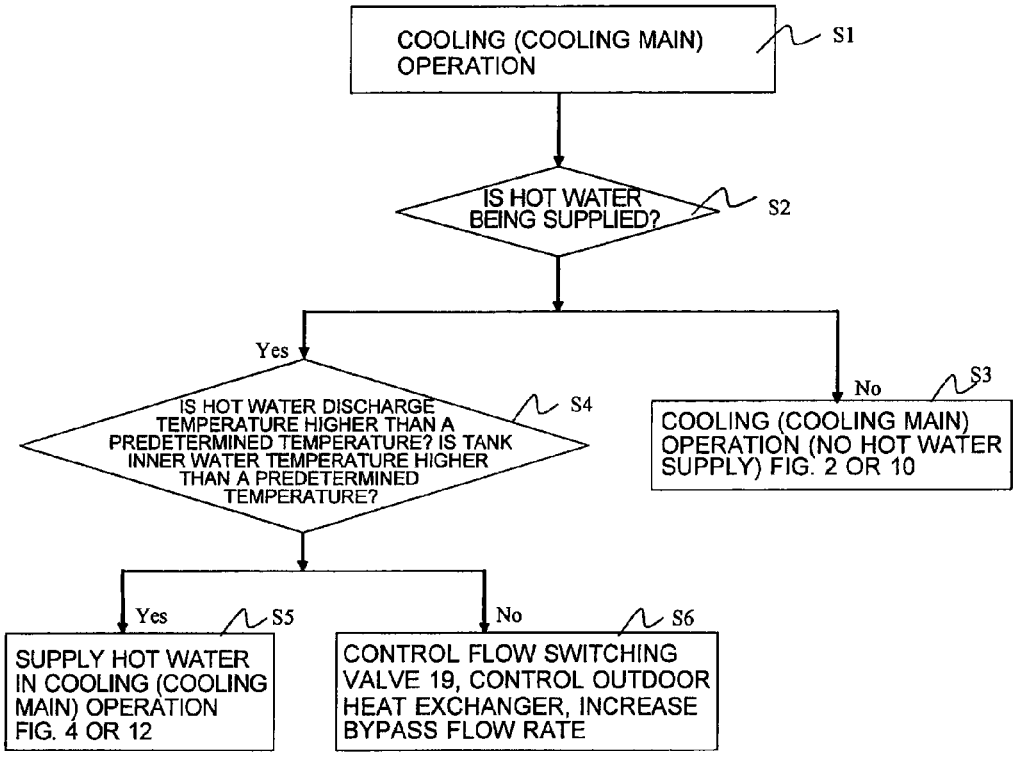
FIG. 20 is a control flowchart for raising the temperature of the refrigerant during the cooling operation and the cooling main operation of the air-conditioning apparatus according to Embodiment 1.

(2) Raising Temperature of Inflowing Refrigerant in Hot Water Supply Device F by Bypassing Outdoor Heat Exchanger FIG. 19 is a refrigerant circuit diagram in the case that the outdoor heat exchanger is bypassed in the air-conditioning apparatus according to Embodiment 1. As shown in FIG. 19, in the heat source unit A of the air-conditioning apparatus 100, a flow switching valve 19 and a bypass piping, through which the refrigerant can bypass the outdoor heat exchanger 3, are provided between the outdoor heat exchanger 3 and the four-way switching valve 2. FIG. 20 is a control flowchart for raising the temperature of the refrigerant during the cooling operation and the cooling main operation of the air-conditioning apparatus according to Embodiment 1. In FIG. 20, steps 1 to steps 5 are the same as in the operation in (1) above, and thus description thereof will be omitted. In the operation in (1) above corresponding to the step 6 of FIG. 20, the four-way switching valve 2 is switched to configure a heating circuit, but here, the flow switching valve 19 is controlled to decrease the flow rate of the refrigerant flowing into the outdoor heat exchanger 3 and increase the refrigerant flowing into the bypass piping. By this control, the amount of heat exchange in the outdoor heat exchanger 3 decreases, and the temperature of the refrigerant flowing into the hot water device F (indicated value of the refrigerant temperature detector 43) increases.

Next, after a predetermined amount of time has passed, similar to step 7 in the operation of (1) above, it is determined whether the cooling capacity has dropped below a target value or whether the heating capacity or hot water supply capacity is excessive. If the cooling capacity has dropped or if the heating capacity or hot water supply capacity is excessive, the flow switching valve 19 is controlled to increase the flow rate of the refrigerant flowing into the outdoor heat exchanger 3. If the hot water supply capacity is insufficient even after the flow switching valve 19 is controlled so that the refrigerant completely bypasses the outdoor heat exchanger 3, the four-way switching valve is switched to configure a heating circuit similar to the operation in (1) above.

In the cooling operation and the cooling main operation, high-temperature hot water can be discharged in accordance with the load even if the necessary hot water supply temperature in the hot water device F is high by control of raising the temperature of the refrigerant flowing into the hot water device F as in the operations in (1) and (2) above.

In Embodiment 1 as described above, since a flow switching valve and a return piping 36*a* are provided to the relay unit B and a water heat exchanger 31 can be connected between the second connecting piping and the first branching unit 10, the hot water device F can be readily added to the relay unit B and hot water can be supplied in each operation mode.

Further, since a carbon dioxide refrigerant is used as the refrigerant and the refrigerant on the discharge side of the compressor 1 reaches a supercritical state, compared to a chlorofluorohydrocarbon refrigerant, the specific heat of gas is large, and it is possible to discharge high-temperature hot water during hot water supply without addition of a load-side refrigerant circuit.

Furthermore, when hot water is supplied in the cooling main operation and the cooling operation, the total capacity of cooling and heating and hot water supply can be improved by utilizing the heat that would originally be exhausted to outdoors, and the operation can be carried out in a high COP state. Further, if the hot water supply temperature is higher than the temperature of the refrigerant that is supplied or if hot water having a high discharge temperature on the hot water tank side is needed, the four-way switching valve 2 is switched so that the high-temperature, high-pressure refrigerant discharged from the compressor 1 flows into the refrigerant side of the water heat exchanger 31 to change to the temperature of the refrigerant. Therefore, high-temperature hot water can be discharged according to the load even if the necessary hot water supply temperature in the hot water device F is high.

In the heating main operation and the heating operation, the water heat exchanger 31 of the hot water device F is connected on the upstream side of the indoor heat exchangers (5*a* to 5*e*) in the passage in which the high-temperature, high-pressure refrigerant discharged from the compressor 1 flows towards the indoor units (E to C). Therefore, the refrigerant can be used in a cascaded manner such that when hot water is supplied during the heating operation or the heating main operation, all of the high-temperature, high-pressure refrigerant discharged from the compressor 1 is made to flow into the water heat exchanger 31 and the refrigerant whose temperature has dropped is used for heating. Thereby, the total performance of heating and hot water supply can be improved.

Embodiment 2

Figure 21:
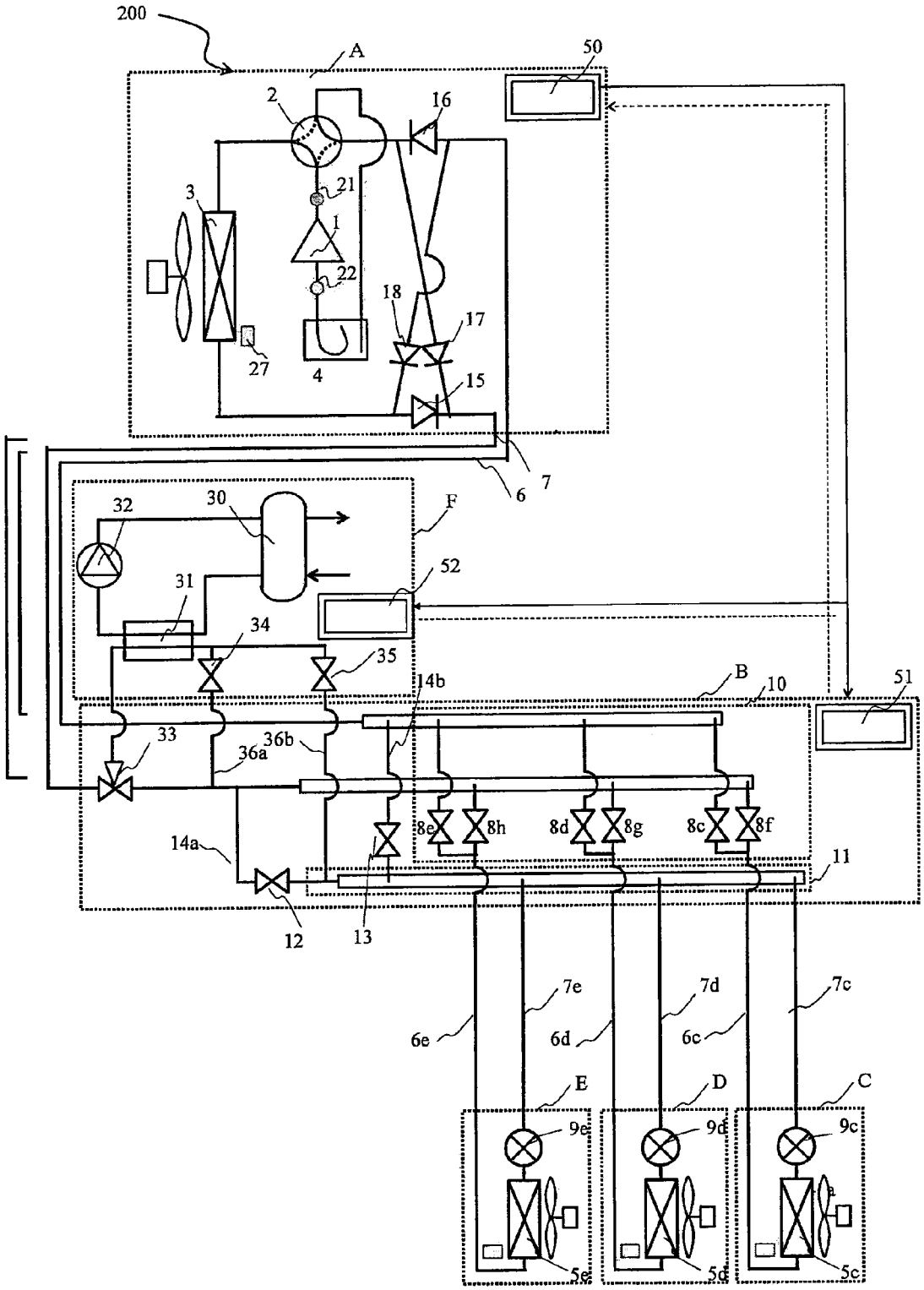
FIG. 21 is a refrigerant circuit diagram showing a refrigerant circuit configuration of an air-conditioning apparatus according to Embodiment 2.

FIG. 21 is a refrigerant circuit diagram showing a refrigerant circuit configuration of the air-conditioning apparatus according to Embodiment 2. Different points from the air-conditioning apparatus 100 according to Embodiment 1 will be described below. In the hot water device F of an air-conditioning apparatus 200 according to Embodiment 2, in addition to the return piping 36*a* and the flow control device 34 by which the water heat exchanger 31 for supplying hot water is serially connected to the indoor units C to E that are performing heating, a return piping 36*b* and a flow control device 35 are also installed so as to connect the water heat exchanger 31 in parallel to the indoor units C to E that are performing heating. The flow control device 34 and the flow control device 35 are constituted by, for example, two-way valves using a stepping motor or the like, and they enable the opening degree of the pipings to be changed to control the flow rate of refrigerant. The flow control device 34, the flow control device 35, the return piping 36*a*, and the return piping 36*a* constitute a third flow switching device.

In Embodiment 1, the hot water device F was serially connected upstream of the indoor units C to E that are performing heating. However, in Embodiment 2, the hot water device F can also be connected in parallel to the indoor units C to E that are performing heating.

If the necessary hot water discharge temperature in the hot water device F is high, and the hot water discharge temperature is to be raised higher than the current hot water discharge temperature, better performance can be achieved by serially connecting the hot water device F upstream of the indoor units C to E that are performing heating so that the entire flow of refrigerant (high-temperature, high-pressure gas refrigerant) flows into the water heat exchanger 31 before flowing into the indoor units C to E, rather than connecting the hot water device F in parallel. On the other hand, if the necessary hot water discharge temperature in the hot water device F is low, and the hot water discharge temperature can be reduced below the current hot water discharge temperature, or if the temperature of water flowing into the water heat exchanger 31 is low, better performance can be achieved by connecting the hot water device F in parallel to the indoor units C to E so that the temperature of the refrigerant at the outlet of the water heat exchanger 31 is sufficiently cooled and the temperature of the refrigerant flowing into the heating units is raised, rather than serially connecting the hot water device F. Below, the circuit when the hot water device F is connected in parallel to the indoor units C to E that are performing heating and the control for switching between serial and parallel connection will be described.

Note that in the cooling operation in which the operation of the indoor units C to E is cooling or stopped, since the outcome is the same whether the refrigerant passes through the return piping 36*a* or the return piping 36*b*, description thereof will be omitted.

Figure 22:
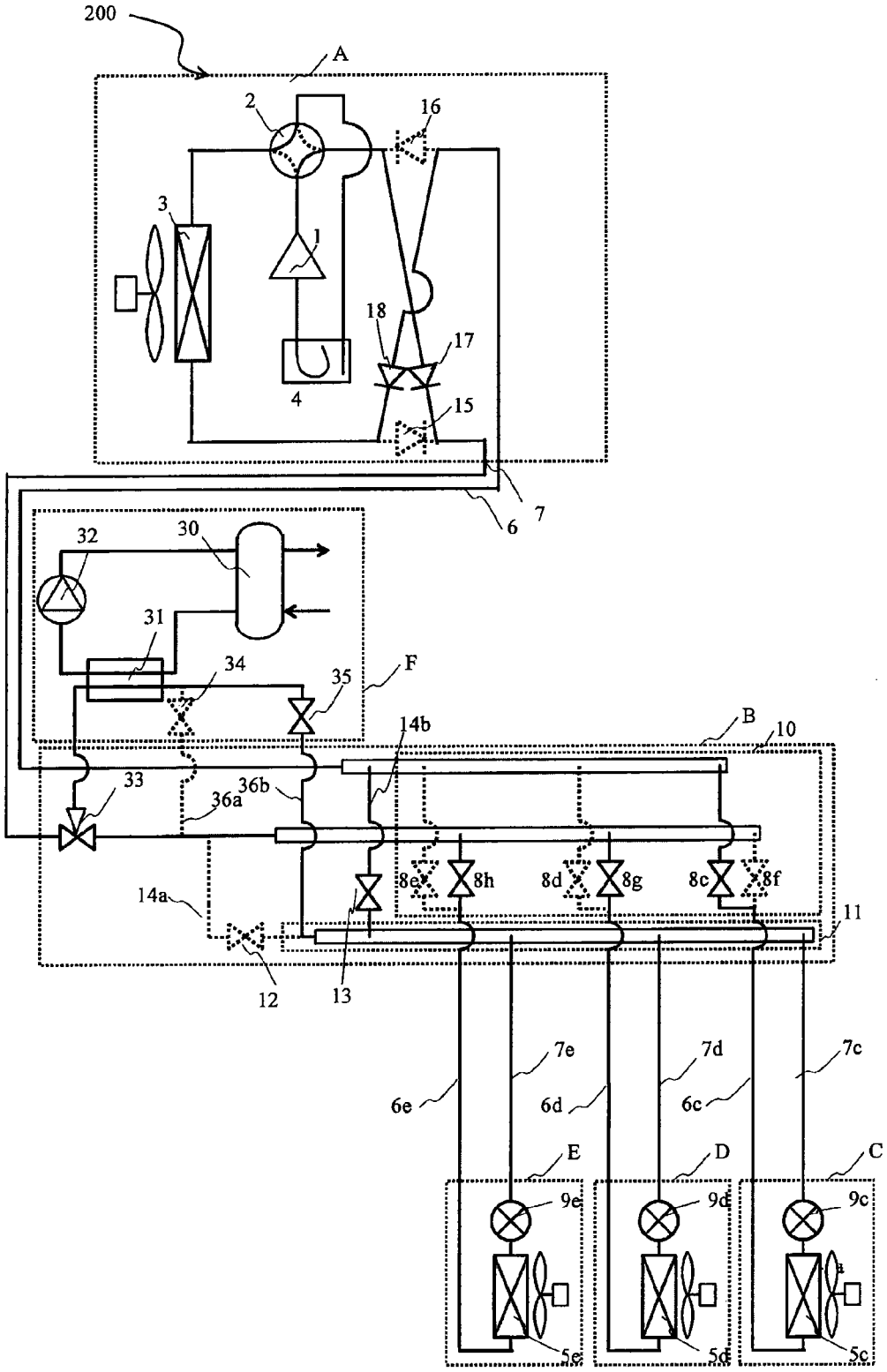
FIG. 22 is a refrigerant circuit diagram showing a flow of refrigerant during a heating operation of the air-conditioning apparatus according to Embodiment 2.
Figure 23:
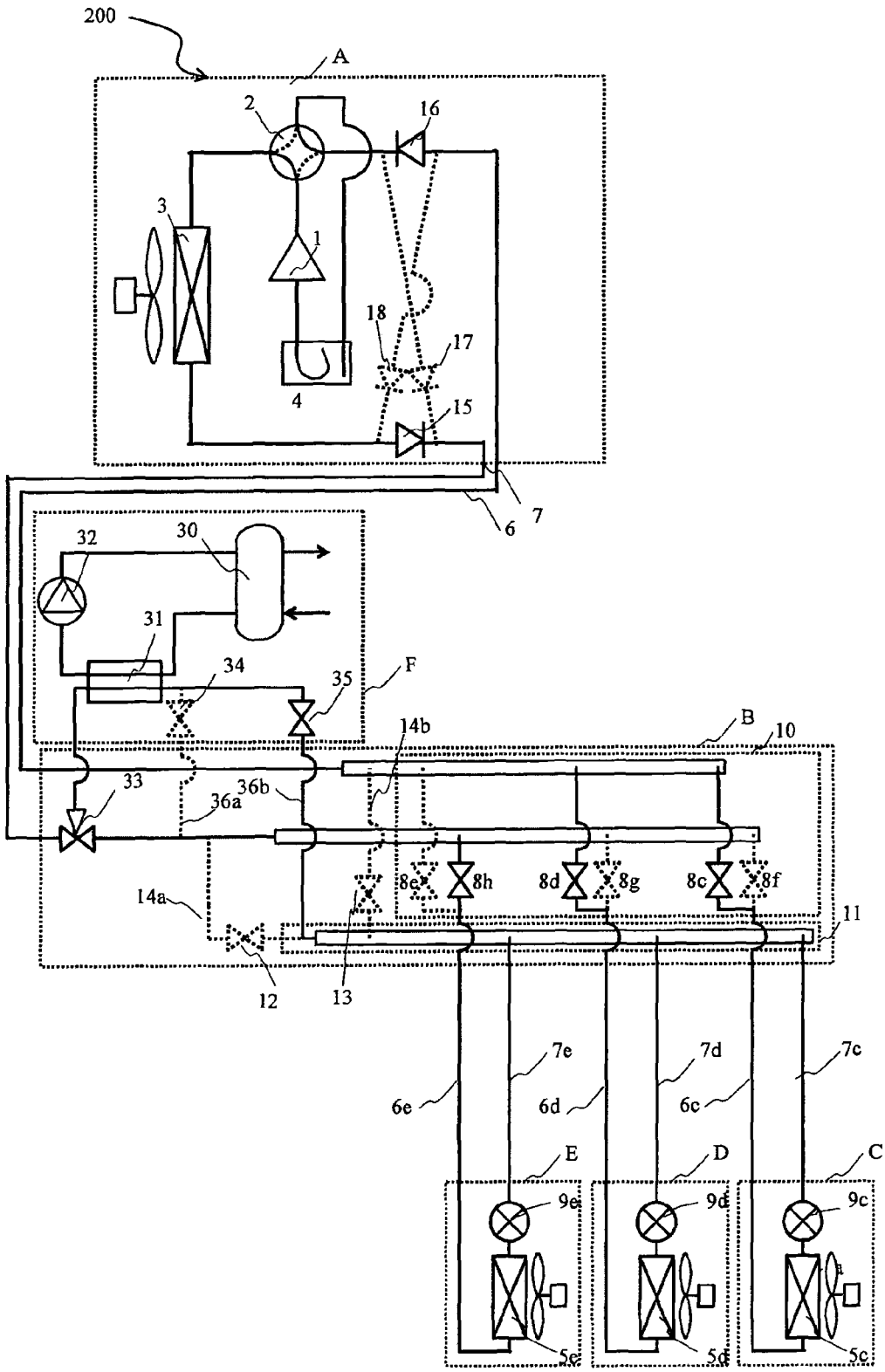
FIG. 23 is a refrigerant circuit diagram showing a flow of refrigerant during a cooling main operation of the air-conditioning apparatus according to Embodiment 2.
Figure 24:
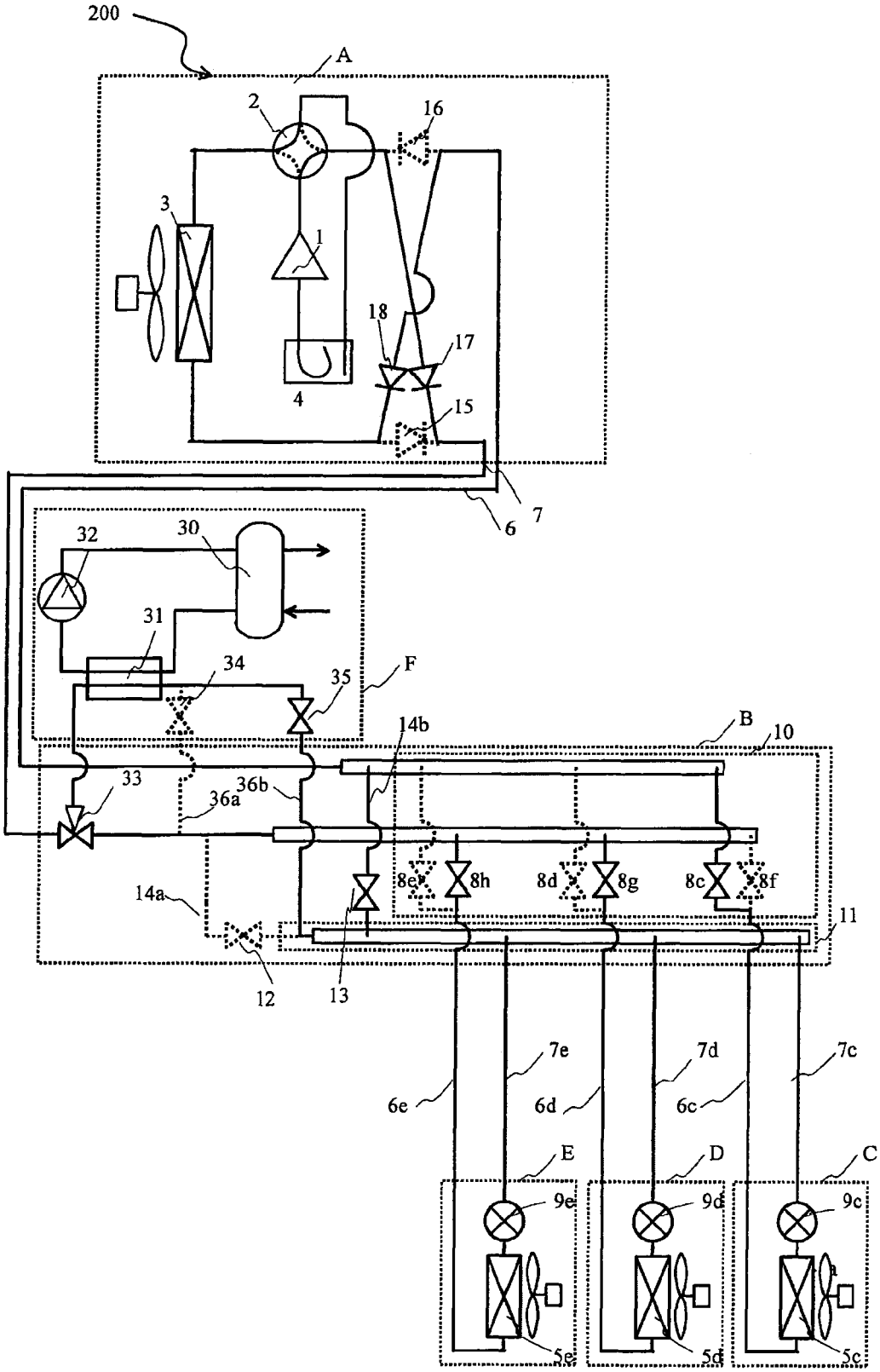
FIG. 24 is a refrigerant circuit diagram showing a flow of refrigerant during a heating main operation of the air-conditioning apparatus according to Embodiment 2.

FIG. 22 is a refrigerant circuit diagram showing the flow of the refrigerant during the heating operation of the air-conditioning apparatus according to Embodiment 2. FIG. 23 is a refrigerant circuit diagram showing the flow of the refrigerant during the cooling main operation of the air-conditioning apparatus according to Embodiment 2. FIG. 24 is a refrigerant circuit diagram showing the flow of the refrigerant during the heating main operation of the air-conditioning apparatus according to Embodiment 2. The cooling and heating operation modes of the indoor units C to E are set in the same way as in Embodiment 1. The flow switching valve 33 is set to, for example, an intermediate opening degree so that resistance of the refrigerant flowing to the hot water device F and the refrigerant flowing to the first branching unit 10 is equal. The flow rate of the refrigerant that has been cooled in the water heat exchanger 31 of the hot water device F is controlled by the flow control device 35. The refrigerant passes through the return piping 36*b* and flows into the second branching unit 11.

Figure 25:
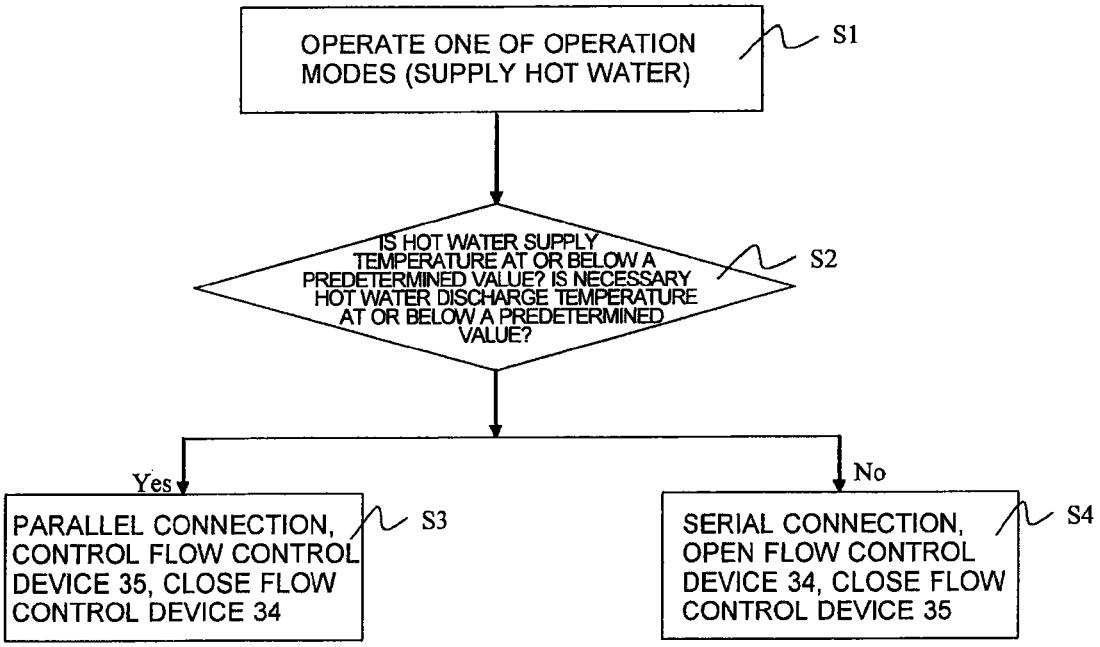
FIG. 25 is a control flowchart for selecting between serial connection and parallel connection when hot water is supplied during each operation mode of the air-conditioning apparatus according to Embodiment 2.

FIG. 25 is a control flowchart for selecting between serial connection and parallel connection when hot water is supplied during each operation mode of the air-conditioning apparatus according to Embodiment 2. First, in step 1, control of the operation mode that has been set from among the cooling operation, the heating operation, the cooling main operation, and the heating main operation is started. In step 2, it is determined whether the hot water supply temperature of the hot water device F is lower than a predetermined value, for example the indoor temperature of the heating indoor units, and whether the necessary hot water discharge temperature is lower than a predetermined value, for example the current hot water discharge temperature of the water heat exchanger 31. If it is determined that the temperature of the water that is supplied is low and the necessary hot water discharge temperature is low and the necessary capacity for hot water supply is low, in step 3, the flow control device 35 is controlled and the flow control device 34 is closed so that the hot water device F and the indoor units (C to E) that are performing heating are connected in parallel. The control of the flow control device 35 is set to an opening degree in accordance with the necessary hot water supply capacity based on, for example, the hot water discharge temperature.

On the other hand, if it is determined that the temperature of the water that is supplied is high or the necessary hot water discharge temperature is high and the necessary capacity for hot water supply is high, in step 4, the flow control device 35 is closed and the flow control device 34 is fully opened so that the hot water device F and the indoor units (C to E) that are performing heating are serially connected. When serially connected, in the same way as in Embodiment 1, the control is performed based on FIG. 18. Additionally, a circuit for bypassing the outdoor heat exchanger 3 can be added as in Embodiment 1 to perform control based on FIG. 20.

In Embodiment 2 as described above, the refrigerant passage is switched between a passage in which the water heat exchanger 31 is connected on the upstream side of the indoor heat exchangers (5*a* to 5*e*) into which high-temperature, high-pressure refrigerant discharged from the compressor 1 flows, and a passage in which the water heat exchanger 31 is connected in parallel to the indoor heat exchangers (5*c* to 5*e*) into which high-temperature, high-pressure refrigerant discharged from the compressor 1 flows. Therefore, the connection can be switched between parallel and serial depending on the water supply temperature and necessary hot water discharge temperature of the hot water device F, and hot water can be supplied under good performance.

If the temperature of water flowing into the water heat exchanger 31 is lower than a predetermined temperature, or the temperature of water flowing out of the water heat exchanger 31 is lower than a predetermined temperature, the water heat exchanger 31 is connected in parallel to the indoor units C to E. Therefore, if the necessary hot water discharge temperature in the hot water device F is low or the temperature of water flowing into the water heat exchanger 31 is low, the temperature of the refrigerant at the outlet of the water heat exchanger 31 can be sufficiently cooled, and better performance can be achieved than when the hot water device F is serially connected.

When the hot water device F does not supply hot water, the water heat exchanger 31 and the second branching unit 11 can be connected by closing the flow switching valve 33 and the flow control device 34 and opening the flow control device 35. Thereby, even if the refrigerant flowing into the relay unit B reaches 100 degrees C. or more, the temperature of the refrigerant retained in the water heat exchanger 31 is approximately the same as that in the second branching unit 11 through which refrigerant that has performed heating passes. Thus, even if the pump 32 is stopped, the operation can be safely stopped without any boiling of the water that is retained in the water heat exchanger 31.

Embodiment 3

Figure 26:
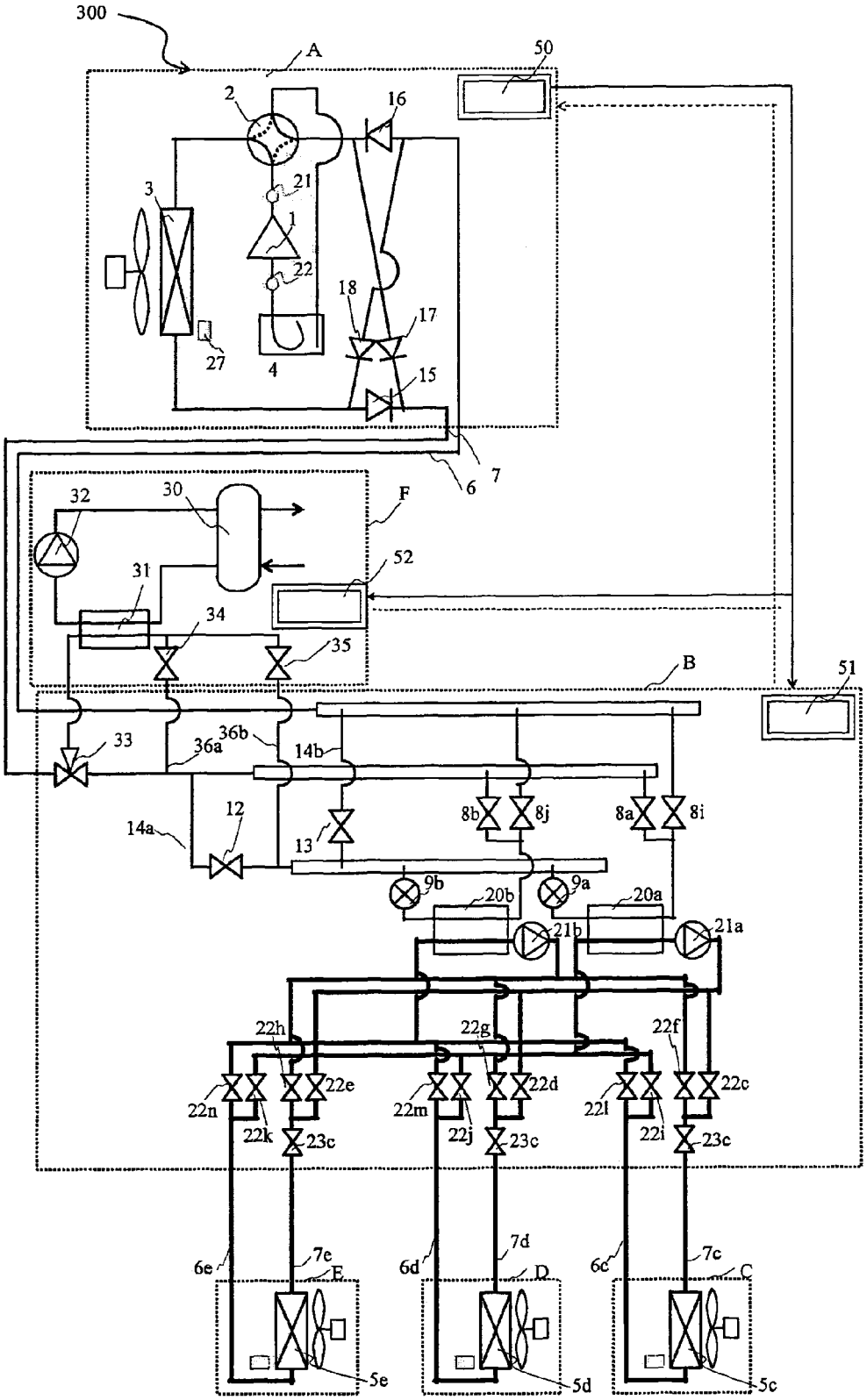
FIG. 26 is a refrigerant circuit diagram showing a refrigerant circuit configuration of an air-conditioning apparatus according to Embodiment 3.

FIG. 26 is a refrigerant circuit diagram showing a refrigerant circuit configuration of the air-conditioning apparatus according to Embodiment 3. Different points from the air-conditioning apparatus 200 according to Embodiment 2 will be described below. In the hot water device F of an air-conditioning apparatus 300 in Embodiment 3, intermediate heat exchangers 20*a* and 20*b* are installed in the relay unit B. In the intermediate heat exchangers 20*a* and 20*b*, refrigerant exchanges heat with brine driven by pumps 21*a* and 21*b* to generate hot water and cold water. As the brine, an antifreeze solution, a mixture of water and antifreeze solution, a mixture of water and an additive having a strong anticorrosive effect, and the like can be used. The brine flows through the bold lined portion in FIG. 26.

Heat transport from the intermediate heat exchangers 20*a* and 20*b* of the relay unit B to the indoor units C to E is carried out by the brine. The brine is supplied from the relay unit B to the indoor units C to E through the second indoor unit-side connecting pipings 7*c* to 7*e* to perform cooling and heating. The brine then passes through the first indoor unit-side connecting pipings 6*c* to 6*e* and returns to the relay unit B. The density of the brine in the second indoor unit-side connecting pipings 7*c* to 7*e* and the first indoor unit-side connecting pipings 6*c* to 6*e* is approximately the same, and thus the piping size can be the same for both pipings.

Solenoid valves 22*c* to 22*h* are installed in the relay unit B for selecting a connection between the second indoor unit-side connecting pipings 7*c* to 7*e* of the indoor units C to E and the intermediate heat exchangers 20*a* and 20*b*. Further, solenoid valves 22*i* to 22*n* are installed for selecting a connection between the first indoor unit-side connecting pipings 6*c* to 6*e* of the indoor units C to E and the intermediate heat exchangers 20*a* and 20*b*. In addition, flow control devices 23*c* to 23*e* that adjust the flow rate of brine flowing into the indoor units C to E are installed between the solenoid valves 22*c* to 22*h* and the indoor units C to E.

Here, although an example in which two intermediate heat exchangers 20*a* and 20*b* are provided is described, Embodiment 3 is not limited to this constitution. If a second refrigerant is constituted to cool and/or heat, any number of intermediate heat exchangers can be installed. Further, the pumps 21*a* and 21*b* are not limited to one each, and a plurality of small capacity pumps can be used serially or in parallel.

In the cooling operation in which all of the indoor units C to E are performing cooling, the intermediate heat exchangers 20*a* and 20*b* generate cold water, and thus function as evaporators. A P-h diagram of the refrigeration cycle side at this time is the same as that in FIG. 3 when hot water is not supplied and the same as that in FIG. 5 when hot water is supplied. On the other hand, in the heating operation in which all of the indoor units C to E are performing heating, the intermediate heat exchangers 20*a* and 20*b* generate hot water, and thus function as radiators. A P-h diagram of the refrigeration cycle side at this time is the same as that in FIG. 7 when hot water is not supplied and the same as that in FIG. 9 when hot water is supplied. In addition, when heating and cooling are simultaneously performed in the indoor units C to E, one of the intermediate heat exchangers 20*a* and 20*b* functions as an evaporator to produce cold water, and the other functions as a condenser to produce hot water. At this time, based on the ratio of the cooling load and the heating load, the connection of the four-way switching valve is switched and the outdoor heat exchanger 3 is selected to function as an evaporator or a radiator to perform cooling main operation or heating main operation. A P-h diagram of the refrigeration cycle side at this time is the same as that in FIG. 11 when hot water is not supplied in the cooling main operation, the same as that in FIG. 13 when hot water is supplied in the cooling main operation, the same as that in FIG. 15 when hot water is not supplied in the heating main operation, and the same as that in FIG. 17 when hot water is supplied in the heating main operation. The operation of the refrigeration cycle side is approximately the same as that in Embodiment 1 or 2.

In the embodiment as described above, the pumps 21*a* and 21*b*, the indoor heat exchangers 5*c* to 5*e*, and the intermediate heat exchangers 20*a* and 20*b* are connected to form a circulating circuit in which a second refrigerant is circulated. The indoor heat exchangers 5*c* to 5*e* exchange heat between the second refrigerant and the indoor air. Therefore, even if refrigerant leaks out from the pipings, refrigerant can be prevented from penetrating into the conditioned space, and a stable air-conditioning apparatus can be obtained.

As in Embodiments 1 and 2 described above, if the heat transport from the relay unit B to the indoor units C to E is carried by the refrigerant, the first flow control devices 9*c* to 9*e* will be installed near the indoor heat exchangers 5*c* to 5*e*. However, when heat is transported by brine as in Embodiment 3, the flow control devices 23*c* to 23*e* can be installed in the relay unit B without any change in the temperature of the brine due to pressure loss in the first indoor unit-side connecting pipings 6*c* to 6*e* and the second indoor unit-side connecting pipings 7*c* to 7*e*, which are brine pipings. Further, if the flow control devices 23*c* to 23*e* are installed in the relay unit B and the temperature difference between brine flowing out and brine flowing in is controlled, since the control valves such as the flow control devices 23*c* to 23*e* are separated away from the indoor conditioned space, noise of the indoor units such as driving of the control valves or flowing noise of the refrigerant when passing through the valves can be reduced.

Since flow control can be collectively controlled in the relay unit B, control in the indoor units C to E can be limited to only control of the fan by information such as the status of the indoor remote control, thermo off, or whether the outdoor unit is defrosting.

In addition, by carrying out heat transport from the heat source unit A to the relay unit B by a refrigerant, the pump used for driving the brine can be reduced in size, and the power for conveying the brine can be reduced to achieve energy saving.

In the refrigerant circuit configuration of Embodiment 3, by controlling the refrigerant based on FIG. 18 or FIG. 20 as described above in Embodiment 1, the hot water device F can be readily added to the relay unit B so that hot water can be supplied in each operation mode.

Embodiment 4

Figure 27:
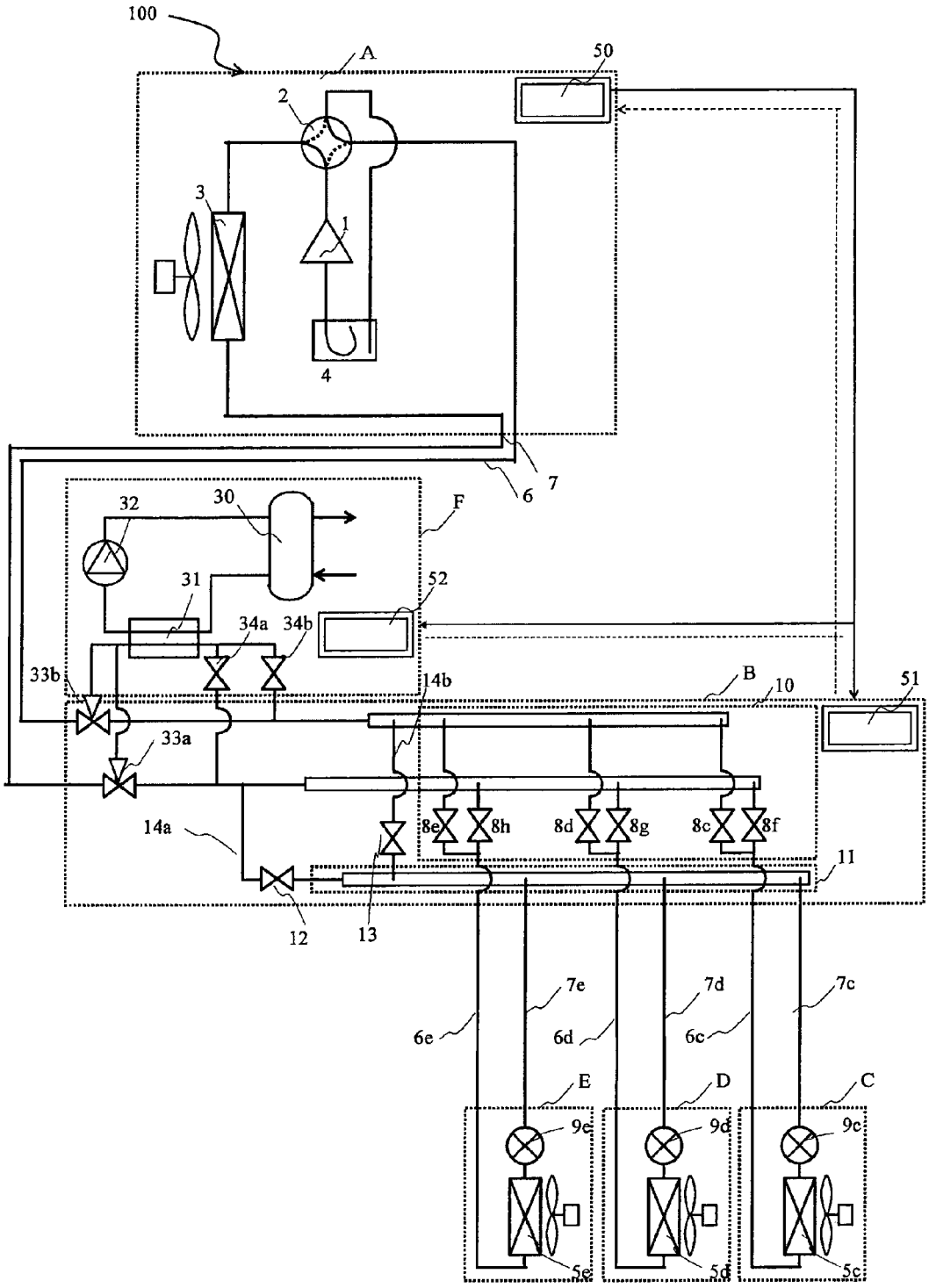
FIG. 27 is a refrigerant circuit diagram showing a refrigerant circuit configuration of an air-conditioning apparatus according to Embodiment 4.
Figure 28:
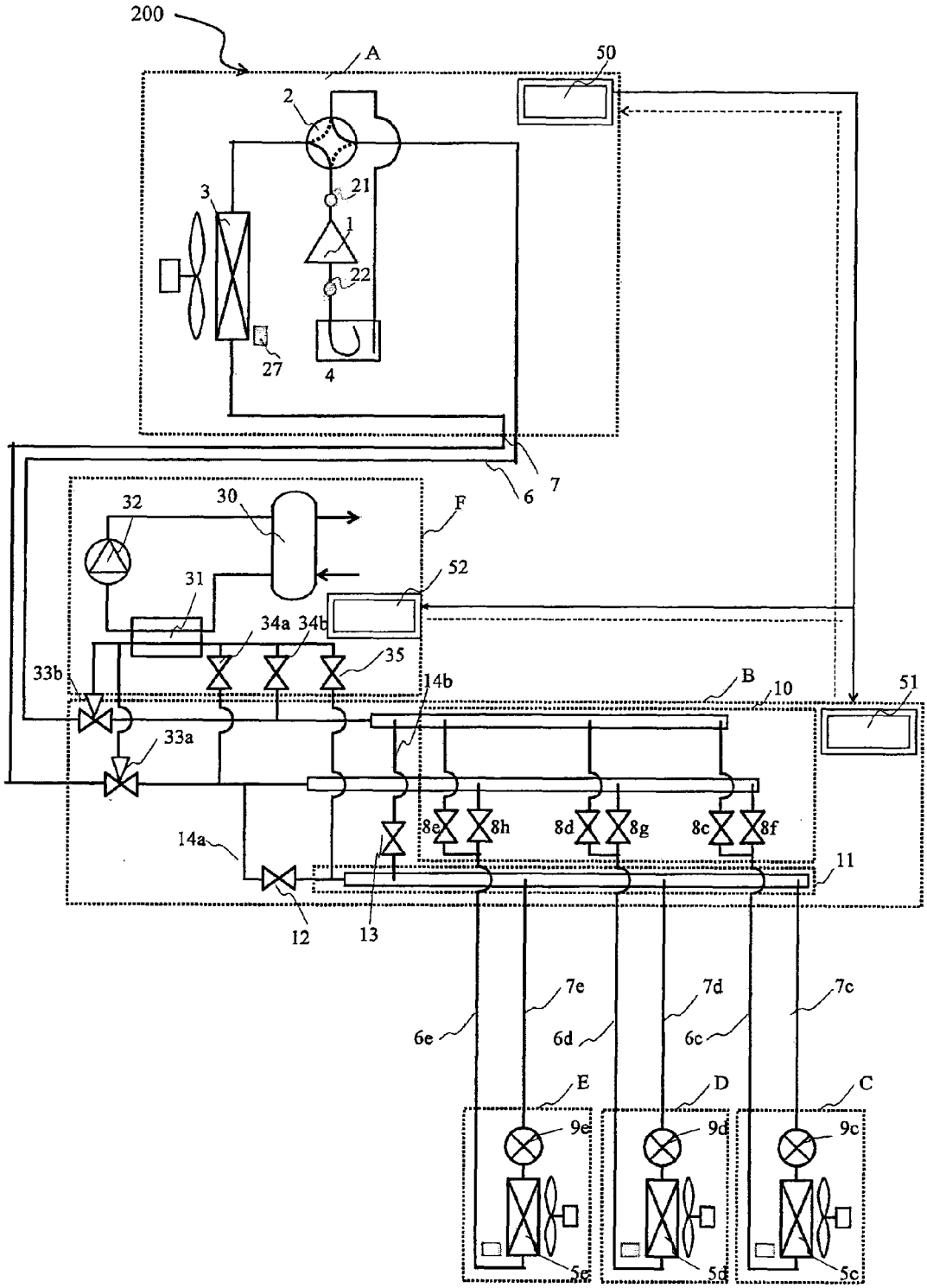
FIG. 28 is a refrigerant circuit diagram showing a refrigerant circuit configuration of an air-conditioning apparatus according to Embodiment 4.
Figure 29:
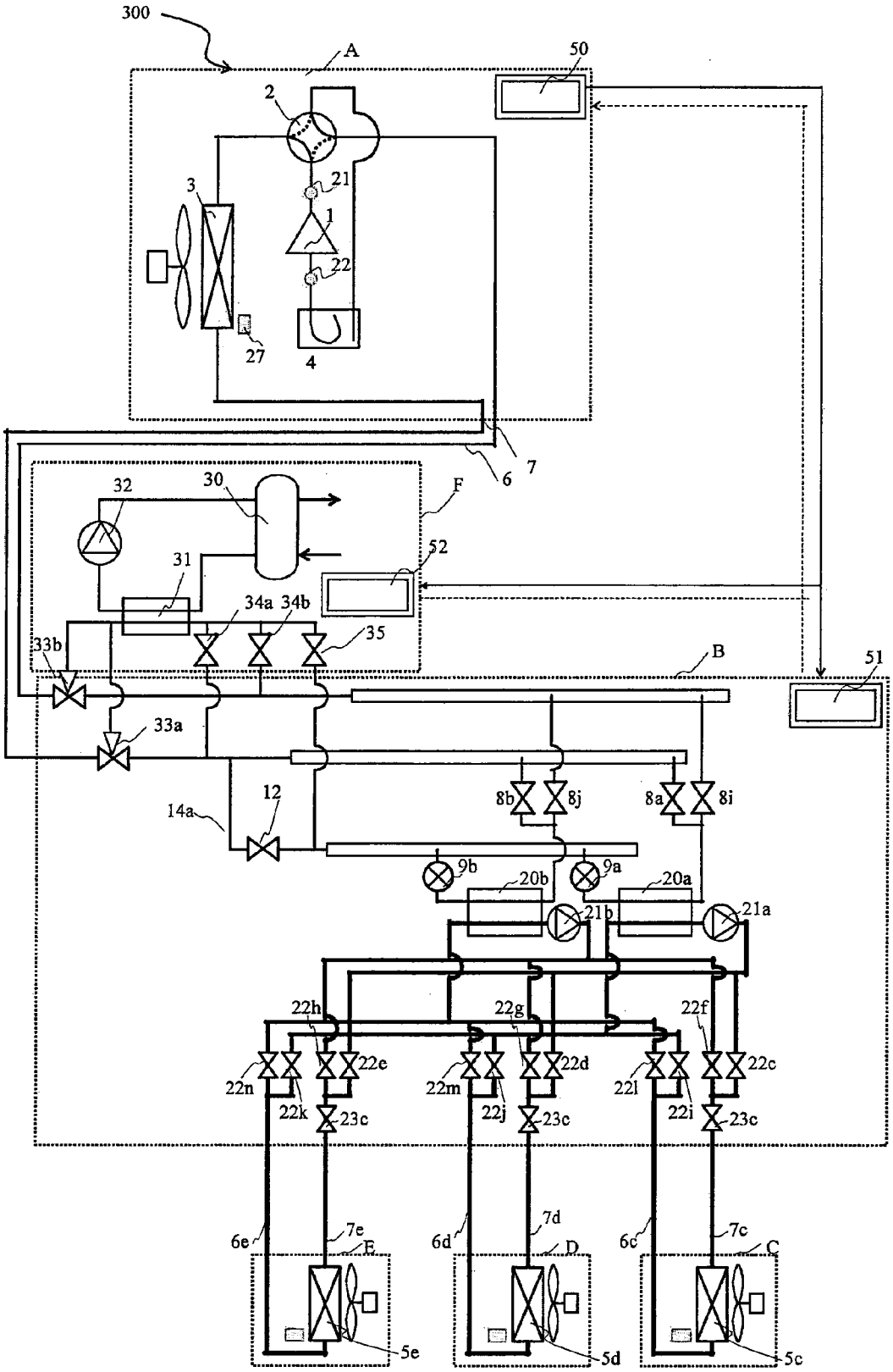
FIG. 29 is a refrigerant circuit diagram showing a refrigerant circuit configuration of an air-conditioning apparatus according to Embodiment 4.

FIGS. 27 to 29 are refrigerant circuit diagrams showing a refrigerant circuit configuration of the air-conditioning apparatus according to Embodiment 4, in which the check valves 15 to 18 constituting the first flow switching device are eliminated from FIG. 1 of Embodiment 1, FIG. 21 of Embodiment 2, and FIG. 26 of Embodiment 3 respectively. In these refrigerant circuits, in the cooling operation and cooling main operation, the flow of the refrigerant is the same as that in the refrigerant circuits previously described. However, in the heating operation and heating main operation, the first connecting piping 6 and the second connecting piping 7, as well as the refrigerant pressure, enthalpy, and flow of refrigerant of the first branching unit 10 are inversed compared to the refrigerant circuits previously described.

In these refrigerant circuits, the refrigerant pipings that are high-pressure pipings are switched in the cooling operation (cooling only operation and cooling main operation) and the heating operation (heating only operation and heating main operation). As the connection circuit of the hot water device F, in addition to a flow switching valve 33*a* and a flow control device 34*a* (33 and 34 in Embodiments 1 to 3) provided on the relay unit B side of the second connecting piping 7, a flow switching valve 33*b* and a flow control device 34*b* are provided on the relay unit B side of the first connecting piping 6, and the connection is switched in accordance with the operation mode so that high-temperature, high-pressure refrigerant flows into the hot water device F. By connecting the hot water circuit as described above, hot water can be supplied regardless of the operation mode in the same way as in the refrigerant circuits shown in Embodiments 1 to 3 even in a refrigerant circuit from which the check valves 15 to 18 have been eliminated.

In Embodiments 1 to 4, a case in which an accumulator 4 is provided to the heat source unit A was described, but the accumulator 4 does not have to be provided. Thus, it goes without saying that the same operation is performed and the same effects are achieved even if the accumulator 4 is not provided.

Generally, there are many cases in which air-sending devices are attached to the outdoor heat exchanger 3 and the indoor heat exchangers 5*c* to 5*e* and condensation or evaporation is promoted by blowing air. However, the invention is not limited to such constitutions. For example, a device such as a panel heater that utilizes radiation can be used as the indoor heat exchangers 5*c* to 5*e*, and a water-cooled type device that transports heat by water or an antifreeze solution can be used as the outdoor heat exchanger 3. In other words, as the outdoor heat exchanger 3 and the indoor heat exchangers 5*c* to 5*e*, any type of device can be used as long as it has a structure that can transfer heat or receive heat. In addition, the number of indoor heat exchangers 5*c* to 5*e* is not particularly limited.

REFERENCE SIGNS LIST

1 compressor; 2 four-way switching valve; 3 outdoor heat exchanger; 4 accumulator; 5*c* indoor heat exchanger; 5*d* indoor heat exchanger; 5*e* indoor heat exchanger; 6 first connecting piping; 6*c* first indoor unit-side connecting piping; 6*d* first indoor unit-side connecting piping; 6*e* first indoor unit-side connecting piping; 7 second connecting piping; 7*c* second indoor unit-side connecting piping; 7*d* second indoor unit-side connecting piping; 7*e* second indoor unit-side connecting piping; 8*c* solenoid valve; 8*d* solenoid valve; 8*e* solenoid valve; 8*f* solenoid valve; 8*g* solenoid valve; 8*h* solenoid valve; 9*c* first flow control device; 9*d* first flow control device; 9*e* first flow control device; 10 first branching unit; 11 second branching unit; 12 second flow control device; 13 third flow control device; 14*a* first bypass piping; 14*b* second bypass piping; 15 check valve; 16 check valve; 17 check valve; 18 check valve; 19 flow switching valve; 20*a* intermediate heat exchanger; 20*b* intermediate heat exchanger; 21*a* pump; 21*b* pump; 22*c* to 22*h* solenoid valve; 23*c* flow control device; 23*d* flow control device; 23*e* flow control device; 30 hot water tank; 31 water heat exchanger; 32 pump; 33 flow switching valve; 33*b* flow switching valve; 34 flow control device; 34*b* flow control device; 35 flow control device; 36*a* return piping; 36*b* return piping; 40 tank inner temperature detector; 41 water temperature detector; 42 water temperature detector; 43 refrigerant temperature detector; 50 control means; 51 control means; 52 control means; 50*a* memory; 51*a* memory; 52*a* memory; 100 air-conditioning apparatus; 200 air-conditioning apparatus; 300 air-conditioning apparatus; A heat source unit; B relay unit; C indoor unit; D indoor unit; E indoor unit; F hot water device.

The invention claimed is:

1. An air-conditioning apparatus comprising:

a heat source unit including a compressor that compresses a refrigerant, a heat source unit-side heat exchanger, and a first flow switching device that changes a flow rate of the refrigerant that is discharged from the compressor and flows into the heat source unit-side heat exchanger;

a plurality of indoor units, each including an indoor unit-side heat exchanger that exchanges heat between the refrigerant and indoor air and a first flow control device that controls a flow rate of the refrigerant;

a relay unit including a branching device that is connected to the heat source unit by two heat source unit-side refrigerant pipings which are branched to each of the plurality of indoor units and is also connected to each of the plurality of indoor units by two indoor unit-side refrigerant pipings, and a second flow switching device that switches a passage of the refrigerant that flows to each of the indoor units; and a hot water device including a water heat exchanger that exchanges heat between the refrigerant and the water, the air-conditioning apparatus being capable of executing the following modes:

a heating operation mode in which a high-temperature, high-pressure refrigerant that has been discharged from the compressor flows into all of the plurality of indoor unit-side heat exchangers to heat indoor air, a cooling operation mode in which a low-temperature, low-pressure refrigerant flows from the heat source unit into all of the indoor unit-side heat exchangers to cool indoor air, and a cooling and heating mixed operation mode in which a high-temperature, high-pressure refrigerant that has been discharged from the compressor flows into one or some of the plurality of indoor unit-side heat exchangers to heat indoor air, and a low-temperature, low-pressure refrigerant flows into one or some of the remaining indoor unit-side heat exchangers to cool indoor air, the air-conditioning apparatus, wherein the relay unit includes a connection circuit between the branching device and the heat source unit, the connection circuit being connected to the water heat exchanger that exchanges heat between the refrigerant and water, the connection circuit branches off the refrigerant from one of the two heat source unit-side refrigerant pipings which supplies the refrigerant from the heat source unit to the relay unit at a branch portion, flows the branched refrigerant into the water heat exchanger, and flows the refrigerant from the water heat exchanger to the one of the two heat source unit-side refrigerant pipings at a downstream side of the branch portion, the cooling and heating mixed operation mode is capable of executing a cooling main operation mode in which the heat source unit-side heat exchanger is connected to a discharge side of the compressor by the first flow switching device and operates as a condenser, and in the cooling main operation mode and the cooling operation mode, when a hot water supply load exists in the hot water device, the first flow switching device operates to decrease or shut off the flow rate of the refrigerant discharged from the compressor and flows into the heat source unit-side heat exchanger, and to increase a flow rate of the refrigerant that is discharged from the compressor into the water heat exchanger and then into at least one of the indoor unit-side heat exchangers without passing through the heat source unit-side heat exchanger, to raise a temperature of the refrigerant flowing into a refrigerant side of the water heat exchanger.

2. The air-conditioning apparatus of claim 1, wherein a refrigerant that reaches a supercritical state on a discharge side of the compressor is used as the refrigerant.

3. The air-conditioning apparatus of claim 1, wherein in the cooling operation mode and the cooling main operation mode, if a hot water supply load exists in the hot water device and a temperature of water flowing out of the water heat exchanger is lower than a predetermined temperature, a passage of the refrigerant is switched by the first flow switching device so that a high-temperature, high-pressure refrigerant that has been discharged from the compressor flows into the refrigerant side of the water heat exchanger to raise a temperature of the refrigerant.

4. The air-conditioning apparatus of claim 1, wherein the heat source unit has a heat source unit-side control device that controls at least an operation of the first flow switching device, the hot water device has a hot water device-side control device that sends data related to an operation status including at least water temperature data of a water temperature detection device to the heat source unit-side control device, and the heat source unit-side control device switches a passage of the refrigerant by the first flow switching device in accordance with the data related to the operation status obtained from the hot water device-side control device.

5. The air-conditioning apparatus of claim 1, wherein the cooling and heating mixed operation mode is capable of executing a heating main operation mode in which the heat source unit-side heat exchanger is connected to a suction side of the compressor by the first flow switching device and operates as an evaporator, and in each of the operation modes including the cooling operation mode, the heating operation mode, the cooling main operation mode, and the heating main operation mode, the water heat exchanger of the hot water device is connected to an upstream side of the indoor unit-side heat exchangers in a passage in which a high-temperature, high-pressure refrigerant that has been discharged from the compressor flows towards the indoor unit-side heat exchangers.

6. The air-conditioning apparatus of claim 1, wherein in each of the operation modes including the cooling operation mode, the heating operation mode, and the cooling and heating mixed operation mode, the hot water device comprises a third flow switching device that switches between a refrigerant passage in which the water heat exchanger is connected to an upstream side of the indoor unit-side heat exchangers into which a high-temperature, high-pressure refrigerant that has been discharged from the compressor flows, and a refrigerant passage in which the water heat exchanger is connected in parallel to the indoor unit-side heat exchangers into which high-temperature, high-pressure refrigerant that has been discharged from the compressor flows.

7. The air-conditioning apparatus of claim 6, wherein the hot water device comprises a water temperature detection device that detects a temperature of water flowing into the water heat exchanger or a temperature of water flowing out of the water heat exchanger, and if a temperature of water flowing into the water heat exchanger is lower than a predetermined temperature or a temperature of water flowing out of the water heat exchanger is higher than a predetermined temperature, a passage of the refrigerant is switched by the third flow switching device so that the water heat exchanger and the indoor unit-side heat exchangers are connected in parallel.

8. The air-conditioning apparatus of claim 1, wherein the relay unit further comprises an intermediate heat exchanger, which exchanges heat between the refrigerant and a second refrigerant, and a pump, the first flow control devices are disposed in the relay unit instead of in the indoor units, the compressor, the heat source unit-side heat exchanger, the first flow control devices, and the intermediate heat exchanger are connected to form a circulating circuit that circulates the refrigerant, the pump, the indoor unit-side heat exchangers, and the intermediate heat exchanger are connected to form a circulating circuit that circulates the second refrigerant, and the indoor unit-side heat exchangers exchange heat between the second refrigerant and indoor air.

9. The air-conditioning apparatus of claim 8, wherein the relay unit further comprises a plurality of intermediate heat exchangers, the second flow switching device switches a passage of the refrigerant flowing from the branching device to each of the intermediate heat exchangers, in the heating operation mode, a high-temperature, a high-pressure refrigerant that has been discharged from the compressor flows to all of the plurality of intermediate heat exchangers to heat the second refrigerant, in the cooling operation mode, a low-temperature, low-pressure refrigerant flows to all of the plurality of intermediate heat exchangers to cool the second refrigerant, and in the cooling and heating mixed operation mode, a high-temperature, high-pressure refrigerant that has been discharged from the compressor flows to one or some of the plurality of intermediate heat exchangers to heat the second refrigerant, and a low-temperature, a low-pressure refrigerant flows to one or some of the remaining plurality of intermediate heat exchangers to cool the second refrigerant.

10. The air-conditioning apparatus of claim 1, wherein the hot water device further comprises a water temperature detection device that detects a temperature of water that flows into the water heat exchanger or a temperature of water that flows out of the water heat exchanger, and if a temperature of water flowing into the water heat exchanger is higher than a predetermined temperature or a temperature of water flowing out of the water heat exchanger is lower than a predetermined temperature, a passage of the refrigerant is switched by the first flow switching device to change a temperature of the refrigerant flowing into the refrigerant side of the water heat exchanger.

11. An air-conditioning apparatus comprising:

a heat source unit including a compressor that compresses a refrigerant, a heat source unit-side heat exchanger, a first flow switching device that switches a passage of the refrigerant in the heat source unit, and a controller that controls switching of the first flow switching device;

a plurality of indoor units, each including an indoor unit-side heat exchanger that exchanges heat between the refrigerant and indoor air and a first flow control device that controls a flow rate of the refrigerant;

a relay unit including a branching device that is connected to the heat source unit by two heat source unit-side refrigerant pipings which are branched to each of the plurality of indoor units and is also connected to each of the plurality of indoor units by two indoor unit-side refrigerant pipings, and a second flow switching device that switches a passage of the refrigerant that flows to each of the indoor units; and a hot water device including a water heat exchanger that exchanges heat between the refrigerant and the water, the air-conditioning apparatus being capable of executing the following modes:

a heating operation mode in which a high-temperature, high-pressure refrigerant that has been discharged from the compressor flows into all of the plurality of indoor unit-side heat exchangers to heat indoor air, a cooling operation mode in which a low-temperature, low-pressure refrigerant flows into all of the indoor unit-side heat exchangers to cool indoor air, and a cooling and heating mixed operation mode in which a high-temperature, high-pressure refrigerant that has been discharged from the compressor flows into one or some of the plurality of indoor unit-side heat exchangers to heat indoor air, and a low-temperature, low-pressure refrigerant flows into one or some of the remaining indoor unit-side heat exchangers to cool indoor air, the air-conditioning apparatus, wherein the relay unit includes a connection circuit between the branching device and the heat source unit, the connection circuit being connected to the water heat exchanger that exchanges heat between the refrigerant and water, the connection circuit branches off the refrigerant from one of the two heat source unit-side refrigerant pipings which supplies the refrigerant from the heat source unit to the relay unit at a branch portion, flows the branched refrigerant into the water heat exchanger, and flows the refrigerant from the water heat exchanger to the one of the two heat source unit-side refrigerant pipings at a downstream side of the branch portion, the cooling and heating mixed operation mode is capable of executing a cooling main operation mode in which the heat source unit-side heat exchanger is connected to a discharge side of the compressor by the first flow switching device and operates as a condenser, and wherein in the cooling main operation mode and the cooling operation mode, when a hot water supply load exists in the hot water device, the controller controls the first flow switching device to switch the passage of the refrigerant in the heat source unit to change a temperature of the refrigerant flowing from the heat source unit into a refrigerant side of the water heat exchanger and then into at least one of the indoor unit-side heat exchangers.

12. An air-conditioning apparatus comprising:

a heat source unit including a compressor that compresses a refrigerant, a heat source unit-side heat exchanger, a first flow switching device that switches a passage of the refrigerant in the heat source unit, and control means for controlling switching of the first flow switching device;

a plurality of indoor units, each including an indoor unit-side heat exchanger that exchanges heat between the refrigerant and indoor air and a first flow control device that controls a flow rate of the refrigerant;

a relay unit including a branching device that is connected to the heat source unit by two heat source unit-side refrigerant pipings which are branched to each of the plurality of indoor units and is also connected to each of the plurality of indoor units by two indoor unit-side refrigerant pipings, and a second flow switching device that switches a passage of the refrigerant that flows to each of the indoor units; and a hot water device including a water heat exchanger that exchanges heat between the refrigerant and the water, the air-conditioning apparatus being capable of executing the following modes:

a heating operation mode in which a high-temperature, high-pressure refrigerant that has been discharged from the compressor flows into all of the plurality of indoor unit-side heat exchangers to heat indoor air, a cooling operation mode in which a low-temperature, low-pressure refrigerant flows into all of the indoor unit-side heat exchangers to cool indoor air, and a cooling and heating mixed operation mode in which a high-temperature, high-pressure refrigerant that has been discharged from the compressor flows into one or some of the plurality of indoor unit-side heat exchangers to heat indoor air, and a low-temperature, low-pressure refrigerant flows into one or some of the remaining indoor unit-side heat exchangers to cool indoor air, the air-conditioning apparatus, wherein the relay unit includes a connection circuit between the branching device and the heat source unit, the connection circuit being connected to the water heat exchanger that exchanges heat between the refrigerant and water, the connection circuit branches off the refrigerant from one of the two heat source unit-side refrigerant pipings which supplies the refrigerant from the heat source unit to the relay unit at a branch portion, flows the branched refrigerant into the water heat exchanger, and flows the refrigerant from the water heat exchanger to the one of the two heat source unit-side refrigerant pipings at a downstream side of the branch portion, the cooling and heating mixed operation mode is capable of executing a cooling main operation mode in which the heat source unit-side heat exchanger is connected to a discharge side of the compressor by the first flow switching device and operates as a condenser, and wherein in the cooling main operation mode and the cooling operation mode, when a hot water supply load exists in the hot water device, the control means controls the first flow switching device to switch the passage of the refrigerant in the heat source unit to change a temperature of the refrigerant flowing from the heat source unit into a refrigerant side of the water heat exchanger and then into at least one of the indoor unit-side heat exchangers.

13. The air-conditioning apparatus of claim 1, wherein the first flow switching device is a valve that switches a passage of the refrigerant discharged from the compressor to flow into the heat source unit-side heat exchanger or into the branching device, and when a hot water supply load exists in the hot water device, the first flow switching device switches the passage of the refrigerant discharged from the compressor to flow into the branching device.

14. The air-conditioning apparatus of claim 1, wherein the heat source unit includes a bypass piping that bypasses the heat source unit-side heat exchanger and a valve that adjusts a flow rate of the refrigerant flowing into the bypass piping, and when a hot water supply load exists in the hot water device, the valve increases the flow rate of the refrigerant flowing into the bypass piping.

15. The air-conditioning apparatus of claim 1, the water heat exchanger is connected to an upstream side piping on an upstream side of the indoor heat exchangers in the passage in which the refrigerant discharged from the compressor flows towards the indoor units, wherein a supply piping branched from the upstream side piping is connected to an inlet of the refrigerant side of the water heat exchanger, and a return piping is connected from an outlet of the refrigerant side of the water heat exchanger to the upstream side piping at a position being on a downstream side of a branching location of the supply piping.

* * * * *